US005998924A

United States Patent [19]

Yamamoto et al.

[11] Patent Number: 5,998,924

[45] **Date of Patent: *Dec. 7, 1999**

[54] IMAGE/FORMING APPARATUS INCLUDING AN ORGANIC SUBSTANCE AT LOW PRESSURE

[75] Inventors: Keisuke Yamamoto, Yamato; Makoto Takagi, Fujieda, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,295

[22] Filed: Apr. 1, 1997

[30] Foreign Application Priority Data

Apr. 3, 1996 [JP] Japan ..... 8-081484

[51] Int. Cl.[6] ..... H01J 19/68; H01J 1/30

[52] U.S. Cl. ..... 313/496; 313/495; 313/355; 313/310; 315/169.4; 445/38; 445/42

[58] Field of Search ..... 313/495, 496, 313/497, 422, 336, 309, 355, 310, 351, 583, 586; 315/169.4, 169.1; 445/36, 38, 42, 3

[56] References Cited

U.S. PATENT DOCUMENTS

| | | | |
|---|---|---|---|
| 4,027,191 | 5/1977 | Schaufele et al. | 313/586 |
| 4,419,605 | 12/1983 | Branston | 313/582 |
| 4,954,744 | 9/1990 | Suzuki et al. | 313/336 |
| 5,185,554 | 2/1993 | Nomura et al. | 313/495 |
| 5,528,109 | 6/1996 | Ilcisin et al. | 315/169.4 |
| 5,591,061 | 1/1997 | Ikeda et al. | 445/3 |
| 5,757,123 | 5/1998 | Nomura et al. | 313/495 |
| 5,847,509 | 12/1998 | Wuest | 313/584 |

FOREIGN PATENT DOCUMENTS

| | | | |
|---|---|---|---|
| 0 660 357 A1 | 6/1995 | European Pat. Off. | H01J 1/30 |
| 0 661 725 A1 | 7/1995 | European Pat. Off. | H01J 31/12 |
| 7-235255 | 5/1995 | Japan | H01J 1/30 |
| 7-235275 | 5/1995 | Japan | H01J 31/15 |

OTHER PUBLICATIONS

"Field Emission", W. P. Dyke et al., *Advances in Electronics and Electron Physics*, vol. VIII (1956), pp. 90–185 (no month).

"Operation of Tunnel–Emission Devices", C. A Mead, *Journal of Applied Physics*, vol. 32 (1961), pp. 646–652 (Apr.).

"Physical properties of thin–film field emmission cathodes with molybdenum cones", C. A. Spindt et al., *Journal of Applied Physics*, vol. 47, No. 12 (1976), pp. 5249–5263 (Dec.).

"The Emission of Hot Electrons and the Field Emission of Electrons from Tin Oxide", M. L. Elinson, *Radio Engineering and Electronic Physics*(1965), pp. 1290–1296 (Jul.).

(List continued on next page.)

*Primary Examiner*—Michael Day

*Attorney, Agent, or Firm*—Fitzpatrick, Cella, Harper & Scinto

[57] ABSTRACT

An image-forming apparatus includes an electron source including one or more than one electron-emitting devices on a substrate, each electron-emitting device having a pair of oppositely disposed device electrodes, an electroconductive film connected to the pair of device electrodes and an electron-emitting region formed in part of the electroconductive film accompanied by a carbonaceous film which contains carbon or carbon compound as principal ingredient and is formed on and in a vicinity of the electron-emitting region, and an image-forming member for forming an image by emitting light when irradiated with electron beams emitted from the electron source. The electron source and the image-forming member are contained in a vacuum envelope, and an organic substance exists in the vacuum envelope to show a partial pressure of the organic substance greater than $1\times10^{-6}$ Pa and a total pressure lower than $1\times10^{-3}$ Pa. The organic substance is so selected that it shows a mean absorption time shorter than the drive period of the electron source.

24 Claims, 19 Drawing Sheets

OTHER PUBLICATIONS

"Electrical Conduction and Electron Emission of Discontinuous Thin Films", G. Dittmer, *Thin Solid Film*, vol. 9 (1972), pp. 317–328 (no month).

"Strong Electron Emission from Patterned Tin–Indium Oxide Thin Films", M. Hartwell et al., *1975 International Electron Devices Meeting Technical Digest*, pp. 519–521 (no month).

"Electroforming and Electron Emission of Carbon Thin Films", H. Araki et al., *Journal of the Vacuum Society of Japan*, vol. 26, No. 1 (1983), pp. 22–29 (no month).

IMAGE/FORMING APPARATUS INCLUDING AN ORGANIC SUBSTANCE AT LOW PRESSURE

BACKGROUND OF THE INVENTION

1. Field of the Invention

This invention relates to an image-forming apparatus comprising an electron source realized by arranging a plurality of electron-emitting devices and a method of manufacturing the same.

2. Related Background Art

CRTs have been widely used for image-forming apparatus for displaying images by means of electron beams.

In recent years, on the other hand, flat panel display apparatus utilizing liquid crystal have been replacing CRTs to some extent. However, they are accompanied by certain drawbacks including that they have to be provided with a back light because they are not of an emissive type and hence there exists a strong demand for emissive type display apparatus. While plasma displays have become commercially available as emissive type display apparatus, they are based on principles that are different from those of CRTs and can not fully compete with CRTs, at least currently, from the viewpoint of contrast, chromatic effects and other technological factors. Since an electron-emitting device appears to be very promising for preparing an electron source by arranging a plurality of such devices and an image-forming apparatus comprising such an electron source is expected as effective as CRT for light emitting effects, efforts have been made in the field of research and development of electron-emitting devices of the type under consideration.

For instance, the applicant of the present invention has made a number of proposals for an electron source realized by arranging a number of surface conduction electron-emitting devices that are cold-cathode type devices and an image-forming apparatus comprising such an electron source.

There have been known two types of electron-emitting device; the thermoelectron emission type and the cold cathode electron emission type. Of these, the cold cathode emission type refers to devices including field emission type (hereinafter referred to as the FE type) devices, metal/insulation layer/metal type (hereinafter referred to as the MIM type) electron-emitting devices and surface conduction electron-emitting devices.

Examples of FE type device include those proposed by W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5248 (1976).

Examples of MIM device are disclosed in papers including C. A. Mead, "Operation of Tunnel-Emission Devices", J. Appl. Phys., 32, 646 (1961).

Examples of surface conduction electron-emitting device include one proposed by M. I. Elinson, Radio Eng. Electron Phys., 10, 1290 (1965).

A surface conduction electron-emitting device is realized by utilizing the phenomenon that electrons are emitted out of a small thin film formed on a substrate when an electric current is forced to flow in parallel with the film surface. While Elinson et al. proposes the use of $SnO_2$ thin film for a device of this type, the use of Au thin film is proposed in G. Dittmer, "Thin Solid Films", 9, 317 (1972), whereas the use of $In_2O_3/SnO_2$ and that of carbon thin film are discussed respectively in M. Hartwell and C. G. Fonstad, "IEEE Trans. ED Conf.", 519 (1975) and in H. Araki et al., "Vacuum", Vol. 26, No. 1, p. 22 (1983).

The applicant of the present patent application has made a number of proposals for surface conduction electron-emitting devices including the one schematically illustrated in FIGS. 2A and 2B. Since the configuration of such a surface conduction electron-emitting device, a method of manufacturing the same and an image-forming apparatus realized by using such devices are disclosed in Japanese Patent Application Laid-Open No. 7-235255, they will be described only summarily here. Referring to FIGS. 2A and 2B, the surface conduction electron-emitting device comprises a substrate 1, a pair of device electrodes 2 and 3 and an electroconductive film 4, which includes an electron-emitting region 5 as part thereof. With a method of producing an electron-emitting region 5, a part of the electroconductive film is deformed, transformed or destroyed to make it electrically highly resistive by applying a voltage to the paired device electrodes. This process is referred to as "energization forming process". In order to produce an electron-emitting region that operates well for electron emission in an electroconductive film, the latter preferably comprises electroconductive fine particles such as fine particles of palladium oxide (PdO). A pulse voltage is preferably used for an energization forming process. A pulse voltage to be used for energization forming may have a constant wave height as shown in FIG. 16A or, alternatively, it may have a gradually increasing wave height as shown in FIG. 16B.

It has also been reported by the applicant of the present patent application that a carbonaceous film that contains carbon as principal ingredient is deposited in and around the electron-emitting region to remarkably increase the rate of electron emission of the device with an activation process. An activation process is typically performed by repetitively applying an appropriate pulse voltage to the electron-emitting region in an atmosphere containing gaseous organic substances.

The carbonaceous film containing carbon or carbon compound as principal ingredient typically comprises graphite (including so-called HOPG, PG and GC, of which HOPG refers to graphite having a substantially perfect crystal structure, while PG and GC respectively refer to one having a somewhat irregular crystal structure with a crystal grain size of about 20 nm and one having a considerably irregular crystal structure with a grain size of about 2 nm) and/or non-crystalline carbon (including amorphous carbon and a mixture of amorphous carbon and graphite containing fine crystal grains).

FIG. 2C of the accompanying drawings schematically illustrates the electron-emitting region and its vicinity. The carbonaceous film may be deposited in a number of different ways depending on the pulse voltages applied to the electron-emitting region. If the pulse polarity is one-directional, a carbonaceous film containing carbon or carbon compound as principal ingredient is formed mainly on the high potential side of the fissure or fissures produced in the energization forming process (as a result of deformation or destruction). Note that, in FIG. 2C, the device electrode 3 represents the high potential side. Electrons are emitted from the fissure and its vicinity. A carbonaceous film may be deposited evenly on the opposite sides of the fissure by carrying out the activation process, frequently switching the polarity of the pulse voltage that is being applied.

Then, the electron-emitting device is preferably subjected to a process referred to as "stabilization process", where the molecules of the organic substances utilized in the activation process that have been adsorbed by the substrate of the electron-emitting device and the inner walls of the vacuum envelope of the image-forming apparatus comprising the device are removed in order to prevent the carbonaceous film containing carbon or carbon compound as principal ingredient from undesirably growing any further and make the device operate stably. More specifically, in a stabilization process, the device is placed and heated in a vacuum vessel while the latter is gradually evacuated by means of an exhaust system for producing ultra-high vacuum typically comprising a scroll pump and an ion pump so that consequently the organic substances remaining on the device are satisfactorily removed to prevent the deposited carbonaceous film from growing any further and make the device operate stably for electron emission.

The problems that arises when no stabilization process is performed include the following as specifically described in Japanese Patent Application Laid-Open No. 7-235275 filed also by the applicant of the present patent application as cited above.

(1) If the electron-emitting device is driven to operate after a long pause, it can show varied electric characteristics (particularly in terms of the current-voltage relationship) such that the emission current produced by the device temporarily grows remarkably.

(2) The emission current of the device changes significantly if the pulse width of the voltage being applied to the device is varied, and as a result, the quantity of electron emitted from the device is hardly controlled by controlling the pulse width.

(3) The electric characteristics of the device are varied by changing the pulse height of the voltage being applied to the device, and as a result, the quantity of electron emitted from the device hardly controlled by controlling the pulse height.

(4) If the device is used in an image-forming apparatus, the brightness and the colors of the image produced by the apparatus is hardly controlled as desired because of the above problems.

The above identified patent publication also discloses that the above problems are attributable to "fluctuations in the volume of organic molecules found in the vacuum atmosphere particularly on the surface and the surrounding areas of the electron-emitting device" so that "the device may be made to show a stable electron-emitting performance without fluctuations in the emission current and the device current by minimizing the partial pressure of organic molecules". It says specifically that the partial pressure of the organic substances in the vacuum vessel is preferably less than $1.3\times10^{-6}$ Pa ($1\times10^{-8}$ Torr), more preferably less than $1.3\times10^{-8}$ Pa ($1\times10^{-10}$ Torr). Additionally, the total pressure in the vacuum vessel is preferably less than $1.3\times10^{-4}$ Pa, more preferably less than $1.3\times10^{-5}$ Pa, and most preferably less than $1.3\times10^{-6}$ Pa.

The above identified patent documents also describe a technique of applying a pulse voltage to the device in vacuum of about $10^{-2}$–$10^{-3}$ Pa ($10^{-4}$–$10^{-5}$ Torr) for an activation process in order to deposit carbon and/or carbon compounds on the device out of the organic substances found in the vacuum. An electron-emitting device that has been subjected to an activation process either shows a performance that the device current If monotonously increases with the device voltage Vf (a property referred to as MI characteristic) or shows a performance characterized by a voltage-controlled-negative-resistance (a property referred to as VCNR characteristic) depending on the conditions of the activation process, the conditions where the performance is observed, and the like. An electron-emitting device with a VCNR characteristic can shift the property depending on the conditions where the characteristic is determined by measurement. More specifically, the electron-emitting device that originally shows a VCNR characteristic shows various characteristics depending on the sweeping rate of the device voltage at the time of measurement, the time period during which the device has been left unoperated before the measurement, the highest voltage applied to the device for the measurement and other factors. For instance, the device can become to show an MI characteristic if the sweeping rate is high, although it is made to show a VCNR characteristic again when the sweeping rate is reduced. While the device shows an MI characteristic for its emission current Ie in any event, the electron-emitting performance of the device remains unstable and varies depending on the conditions of measurement.

After a stabilization process conducted to avoid the above listed problems, the device shows a relationship between the device voltage and the device current that is unequivocally defined within an operating voltage range under a maximum voltage limit. In other words, the device comes to show a monotonously increasing characteristic (MI characteristic) so that the relationship between the device voltage and the emission current is also unequivocally defined to avoid the above listed problems.

Thus, as a result of the stabilization process for stabilizing the electron-emitting performance of the electron-emitting device, the organic substances used to produce the carbonaceous film containing carbon or carbon compound as principal ingredient are effectively removed. However, a problem arises on the electron-emitting device if the carbonaceous film containing carbon or carbon compound as principal ingredient is lost for some reason or other because the organic substances used to produce the carbonaceous film are already gone and hence the carbonaceous film cannot be restored. Additionally, the electron-emitting device can gradually lose the carbonaceous film that contains carbon as principal ingredient to degrade its electron-emitting performance particularly when it is operated continuously for a prolonged period of time. The carbonaceous film may be lost for a number of reasons including evaporation due to the electric field applied to the electron-emitting region, evaporation due to the Joule's heat generated by the device current and the etching effect of ions colliding with the carbonaceous film.

SUMMARY OF THE INVENTION

In view of the above identified problems, it is therefore a primary object of the present invention to provide an image-forming apparatus that can effectively suppress any degradation in the electron-emitting performance and prolong its service life.

Another object of the present invention is to provide an image-forming apparatus comprising an electron source formed by arranging one or more than one electron-emitting devices, each being provided with a carbonaceous film formed in and near the electron-emitting region and containing carbon or carbon compound as principal ingredient that can effectively suppress any degradation in the electron-emitting performance and prolong its service life while preventing fluctuations in the electron-emitting performance.

According to the invention, the above objects are achieved by providing an image-forming apparatus comprising an image-forming apparatus comprising an electron source including one or more than one electron-emitting devices on a substrate, each electron-emitting device having a pair of oppositely disposed device electrodes, an electroconductive film connected to the pair of device electrodes and an electron-emitting region formed in part of the electroconductive film accompanied by a carbonaceous film which contains carbon or carbon compound as principal ingredient and is formed on and in a vicinity of the electron-emitting region, and an image-forming member for forming an image by emitting light when irradiated with electron beams emitted from the electron source, the electron source and the image-forming member being contained in a vacuum envelope, characterized in that an organic substance exists in the vacuum envelope to show a partial pressure of the organic substance greater than $1\times10^{-6}$ Pa and a total pressure lower than $1\times10^{-3}$ Pa, the organic substance being so selected that it shows a mean absorption time shorter than the drive period of the electron source.

According to another aspect of the invention, there is provided a method of manufacturing an image-forming apparatus according to claim 5, characterized in that the organic substance having a mean absorption time shorter than the drive period of the electron-emitting devices is $CH_4$ (methane), $C_2H_4$ (ethylene), $C_2H_2$ (acetylene) or $C_4H_2$ (butadiyne).

DESCRIPTION OF THE PREFERRED EMBODIMENTS

Figure 1:
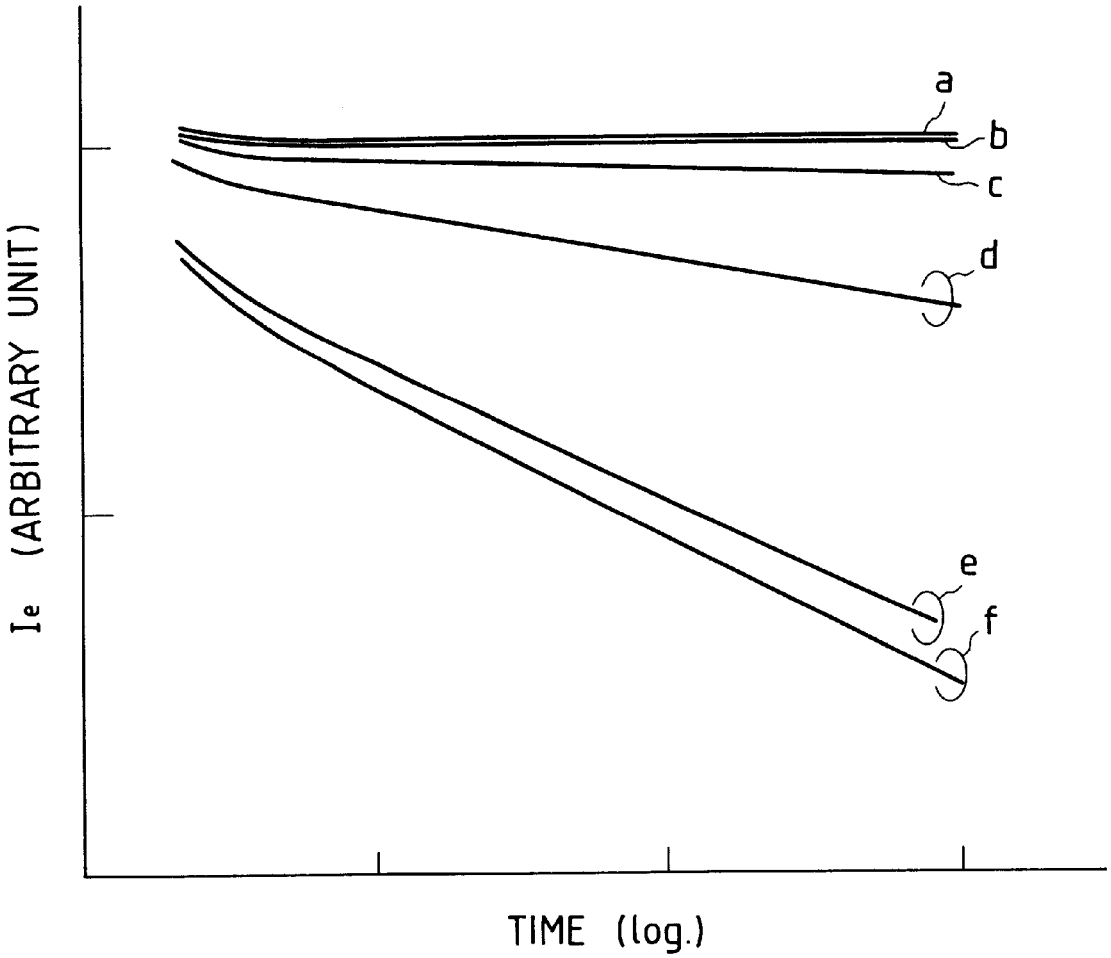
FIG. 1 is a graph illustrating the change with time of the emission current of an embodiment of image-forming apparatus according to the invention and a comparably known apparatus.

A conceivable method of preventing the above described phenomenon of degradation of the performance of any of the electron-emitting devices of an image-forming apparatus may be to supply the organic substances same as those used for forming the carbonaceous film containing carbon or carbon compound as principal ingredient into the vacuum envelope of the image-forming apparatus in order to compensate the lost portions of the carbonaceous films of the electron-emitting devices. However, this method is accompanied by a variety of problems that arises in the electron-emitting performance of the electron-emitting devices due to the organic substances that can remain on and in a vicinity of the devices. Therefore, this invention is intended to provide a method of compensating the portions of the carbonaceous films of the electron-emitting devices containing carbon or carbon compound as principal ingredient and lost in the course of the operation of driving the devices in order to suppress any degradation in the electron-emitting performance of the devices and give them a prolonged service life.

Now, the present invention will be described in detail.

The inventors of the present invention discovered that the above identified objects of the present invention can be achieved by sealing organic substances having a short mean absorption time in the vacuum envelope after thoroughly removing the organic substances remaining in the envelope. The inventors also found that the occurrence of leak current can be effectively prevented by adding hydrogen gas to the gas of the organic substances having a short mean absorption time.

The mean absorption time as used herein is defined as the mean time period from the time when molecules are adsorbed by the inner wall of the vacuum envelope and the surface of the substrate to the time when they are released from the adsorbed state. The mean absorption time can vary depending on the mass of the molecules, the existence of polarization and other factors including the relationship between the adsorber and the adsorbed in a strict sense of the word.

While molecules of gaseous substances may be adsorbed by the surface of a solid either physically or chemically, it is mainly physical adsorption that matters for the purpose of the invention. Chemical adsorption typically involves a large amount of adsorption energy and the molecules of a gaseous substance that are chemically adsorbed would not be released easily. Thus, gaseous substances that can easily be chemically adsorbed are not suited for being sealed in vacuum envelopes.

The mean absorption time $\tau$ is expressed by equation (1) below, $$\tau=\tau_0 \cdot exp(U/kT) \quad (1)$$

where U is the energy of adsorption, k is the Boltzmann constant and T is the temperature. $\tau_0$ represents a quantity typically referred to as "frequency factor" and has a value of about $10^{-13}$ sec.

The heat E generated by adsorption of a mole of gas molecules is referred to as adsorption heat and expressed in terms of adsorption energy by equation $E=N_a U$, where $N_a$ is the Avogadro's number.

While the adsorption heat or adsorption energy of a given number of molecules of a gaseous substance varies depending on the adsorber in a strict sense of the word and hence cannot be defined unequivocally, typically it is a slightly greater than the heat of vaporization for that number of molecules of the substance. Possible maximal values for a number of different gaseous substances have been determined by estimate.

For instance, estimated maximal adsorption energy values for different gaseous substances are listed in Table 1.1, p.60, in "The Technology of Vacuum" (edited by the Technology of Vacuum Editing Committee and published by Sangyo Gijutu Service Center, Nov. 26, 1990), including $3.47\times10^{-20}$ J (Joules) for $CH_4$, $5.55\times10^{-20}$ J for $C_2H_4$ and $6.25\times10^{-20}$ J for $C_2H_2$.

The values of $\tau$ at 300K can be calculated by using equation (1) above to obtain $4.35\times10^{-10}$ sec. for $CH_4$, $6.60\times10^{-8}$ sec. for $C_2H_4$ and $3.57\times10^{-7}$ sec. for $C_2H_2$.

Figure 14:
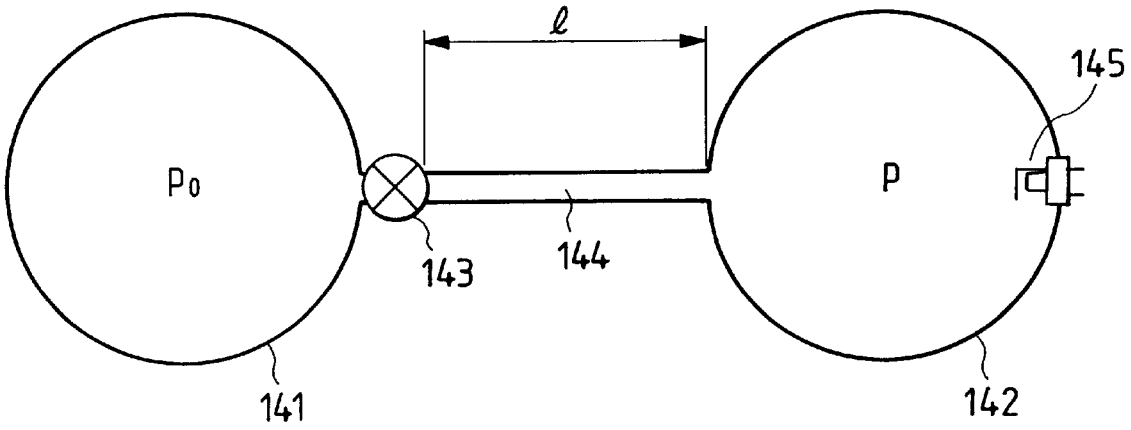
FIG. 14 is a schematic diagram of a gauging system for measuring the mean absorption time.
Figure 15:
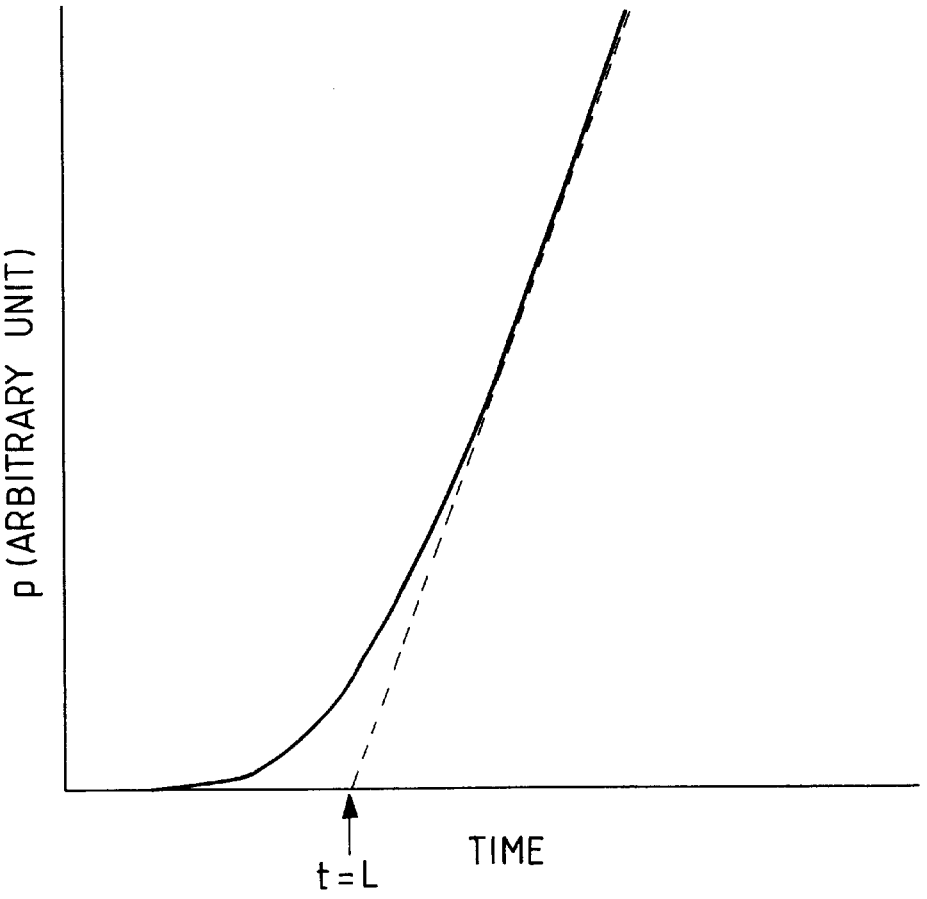
FIG. 15 is a graph illustrating a method for determining the mean absorption time from the results obtained by the gauging system of FIG. 14.
Figure 16A:
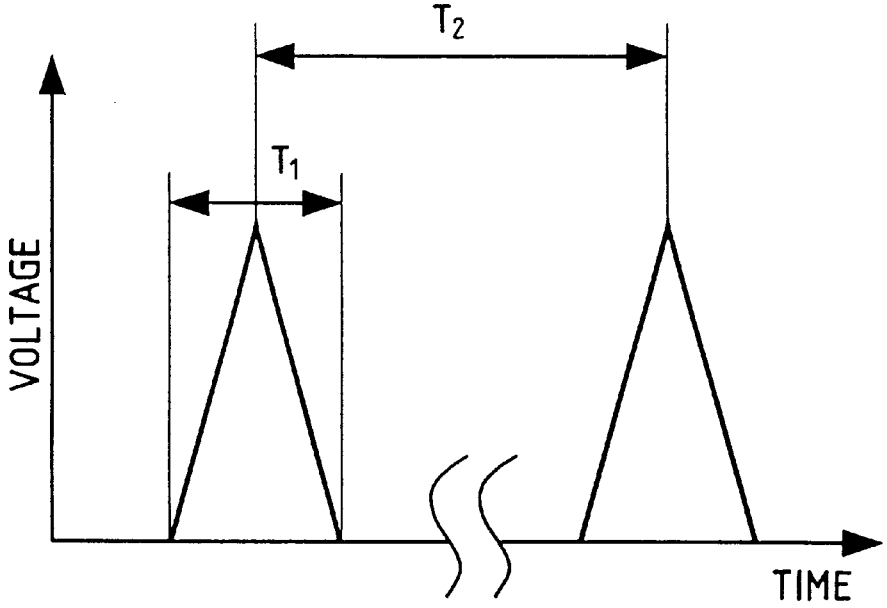
FIGS. 16A and 16B are graphs illustrating two different voltage pulses that can be used for the energization forming process in the manufacture of an image-forming apparatus according to the invention.
Figure 16B:
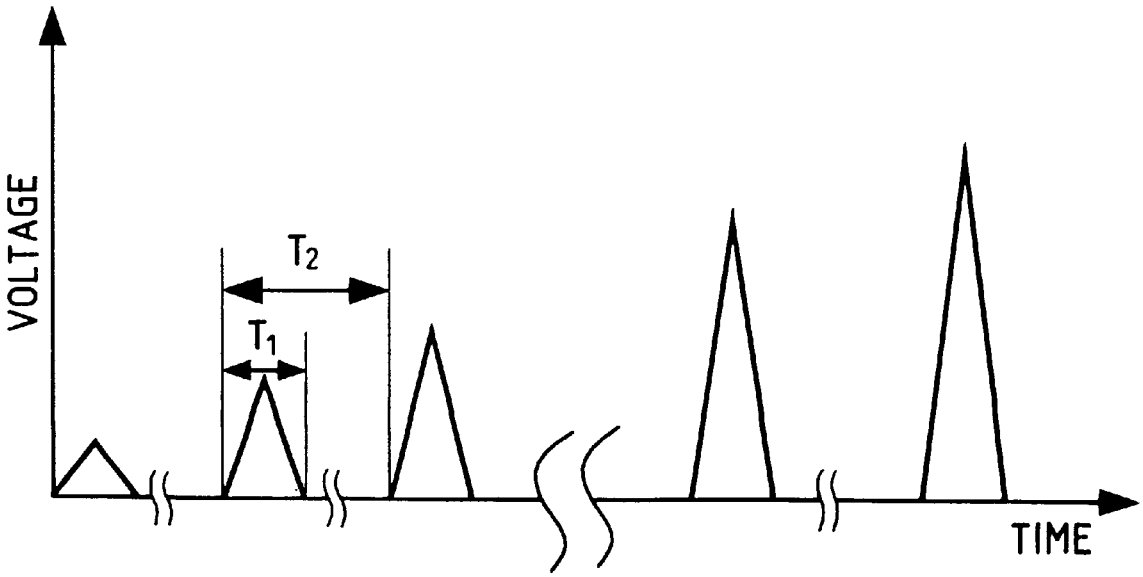

The value of $\tau$ can be experimentally determined with relative ease for gaseous substances if they have large $\tau$ values. FIG. 14 schematically illustrates a gauging system for measuring the mean absorption time, where a pair of vacuum containers 141 and 142 are connected with each other by way of a small tube 144 having a length l and an inner radius of r and one of the containers is provided with a gate valve 143. The gas to be observed for the mean absorption time is put into the vacuum container 141 to show pressure $p_0$. Note that the pressure in the container 141 should not be so high that it produces a viscous gas flow through the pipe 144 when the gate valve 143 is opened to allow the gas to flow out of the container 141. On the other hand, the vacuum container 142 is evacuated to show an internal pressure sufficiently lower than pressure $p_0$. The vacuum container 142 is provided with a pressure gauge 145 so that the internal pressure can be measured at any time. Once the gate valve 143 is opened, internal pressure p of the vacuum container 142 increases in a manner as indicated by a curved line in FIG. 15. Within a range where the internal pressure of the vacuum container 141 does not depart significantly from $p_0$, pressure p changes with time to gradually come closer to the straight broken line in FIG. 15.

If the value at which the broken straight line intersects the time coordinate axis is L or t=L, L can be approximately expressed by formula (2) below, $$L\cong(1/8)(l^2/r)\beta s\tau \quad (2)$$

where $\beta$ is the "roughness constant", which is about 1 if a tube having a smooth inner surface is used, and s is the adsorption probability with which molecules colliding with the inner wall of the tube are adsorbed without elastic scattering and which may be regarded to be substantially equal to 1 for molecules having a large $\tau$ value because they will be adsorbed almost without fail. Thus, the value of $\tau$ can be approximately determined by measuring the internal pressure of the vacuum container 142 that changes with time. (See "A measurement of Mean Absorption Time of Oil Molecules by the Non-Stationary Flow Method (Part I)", Vacuum, Vol. 6, pp.320–328, 1963.)

While the exact causes of the phenomenon described earlier have not been identified, it may be explained, at least partly, by the following description.

The carbonaceous film formed on the electron-emitting region by deposition and containing carbon or carbon compound as principal ingredient plays an important role in the operation of emitting electrons. More specifically, as illustrated schematically in FIG. 2C, a carbonaceous film containing carbon or carbon compound as principal ingredient is formed by deposition around a fissure formed in the electroconductive film and a fissure of the carbonaceous film is formed in the fissure of the electroconductive film. For the device to emit electrons actively at an enhanced rate, the fissure may have to show a limited width.

As the electron-emitting device is driven to operate, the intense electric field is applied to the area containing the fissure Joule's heat is generated by and the electric current flowing therethrough to consequently evaporate the carbonaceous film containing carbon or carbon compound as principal ingredient so that the latter will gradually be lost.

Additionally, some of the molecules of the gaseous substance remaining in the vacuum envelope collide with electrons emitted from the electron-emitting device to become ionized so that the carbonaceous film containing carbon or carbon compound as principal ingredient will additionally be lost as it is sputtered. As a result, the fissure of the film coat is broadened to reduce the rate of electron emission. On the other hand, the molecules of the organic substances sealed in the vacuum envelope are partly adsorbed to and near the electron-emitting region and energized there to accelerate the additional deposition of the carbonaceous film containing carbon or carbon compound as principal ingredient. Consequently, the rate of electron emission is increased.

Thus, if the above processes proceed in opposite directions simultaneously in an equilibrated manner, the carbonaceous film containing carbon or carbon compound as principal ingredient will not be reduced and the electron-emitting device will be protected against degradation to operate stably. While it is desirable that the two processes are perfectly equilibrated and the performance of the electron-emitting device does not change with time, there will be a certain margin for fluctuations in the processes.

While such an equilibrated condition where organic substances exist within the vacuum envelope may appear to be an retrogression to a stage prior to the stabilization process, the electron-emitting device can maintain its characteristic electron-emitting property obtained as a result of the stabilization process through the use of organic substances having a short mean absorption time.

The effect of using organic substances having a short mean absorption time will be explained by the following description.

While the electric characteristics of an electron-emitting device may vary as a function of the change in the carbonaceous film around the electron-emitting region containing carbon or carbon compound as principal ingredient in a manner as described above, they may also be affected by the molecules adsorbed to and near the electron-emitting region if they are not aggregated to a carbonaceous film. As molecules of organic substances are adsorbed to and near the electron-emitting region, electric paths may be formed in some cases to bridge the fissure, or the effective width of the fissure may be narrowed and consequently raise the intensity of device current If flowing therethrough.

When the electron-emitting device is driven by applying a pulse voltage, the adsorbed molecules of the organic substances will partly be released due to the electric field applied thereto and the Joule's heat generated there (while some of the remaining molecules may be aggregated to produce a carbonaceous film containing carbon). On the other hand, when the application of the pulsed voltage is suspended, molecules of the organic substances in the ambient gaseous phase will hit the electron-emitting region and be adsorbed there to establish an equilibrated condition and determine the electric characteristics of the device.

Assume now that a pulse voltage is applied at regular intervals to make the device show a certain set of electric characteristics and then the application of pulse voltage is suspended. If the mean absorption time of the molecules of the organic substances is longer than the pulse interval, the quantity of adsorbed molecules of the organic substances will increase and the device current If will temporarily be raised when the application of pulse voltage is resumed. Then, the emission current Ie will change as it is affected by the device current. This means that each pixel of an image-forming apparatus show a level of brightness undesirably higher than a normal level after a darkened pause. If, on the other hand, the mean absorption time of the molecules of the organic substances is shorter than the pulse interval, the quantity of adsorbed molecules of the organic substances has reached to an equilibrated state when the application of pulse voltage is resumed and it will not be changed if the interval of pulse application is prolonged so that no fluctuations in the brightness of each pixel will not occur to the advantage of the image-forming apparatus.

The phenomenon that the emission current varies as a function of the pulse width of the drive pulse voltage may be attributable to the fact that the interval of pulse application also changes as a function of the change in the pulse width. Thus, it may be safe to presume that the present invention is realized by advantageously exploiting the above described effect.

The pulse interval is equal to the drive period of the devices in an image-forming apparatus. Therefore, the mean absorption time of the organic substances sealed in the vacuum envelope of the apparatus has to be shorter than the drive period.

Change in the electric characteristics of the electron-emitting device that occurs when a drive pulse voltage changes may be attributable to change in the amount of molecules of the organic substances adsorbed to and near the electron-emitting region given rise to by the drive pulse voltage. For instance, in the process where molecules of the organic substances are released from the adsorbed state as a pulse voltage is applied thereto, the intensity with which the electric field affects the molecules can be raised to raise the rate at which they are released if a large amount of molecules of the organic substances have been adsorbed to narrow the effective width of the fissure. The electron-emitting performance of the device is stabilized for the time being when the rate of release is equilibrated with the rate of adsorption. Then, as the wave height of the pulse voltage is lowered, the rate of the release of molecules due to the applied electric field is reduced to increase the net rate of the adsorption of molecules of the organic substances until the width of the fissure is reduced and eventually the two rates become equilibrated for another time. This process of getting to an equilibrated state applies not only to the release of molecules due to the application of an electric field but also to the release of molecules due to the generated Joule's heat.

On the other hand, with molecules of organic substances having a short mean absorption time, the quantity of adsorbed molecules is relatively small in an atmosphere with a pressure level comparable to that of the partial pressure of the organic substances selected for the purpose of the invention due to the short mean absorption time so that the electric characteristics of the electron-emitting device may not be significantly affected if the quantity changes to some extent.

In any case, the electron-emitting device will show an MI characteristic where the relationship between the device current If and the device voltage is not affected by the sweeping rate of the device voltage at the time of measurement nor by the maximum value of the voltage applied to for the measurement (within the range of normal drive voltage) so that the device current is unequivocally defined by the device voltage if the organic substances to be sealed in the vacuum envelope is selected by giving due consideration to the mean absorption time. Thus, according to the invention, it is possible to provide an electron-emitting device that is free from the problem of a temporary increase in the emission current immediately after a pause, that of pulse-width dependency of the emission current and that of change of electric characteristics due to changes in the pulse voltage and can effectively avoid degradation in the electron-emitting performance of an electron-emitting device.

Figure 20:
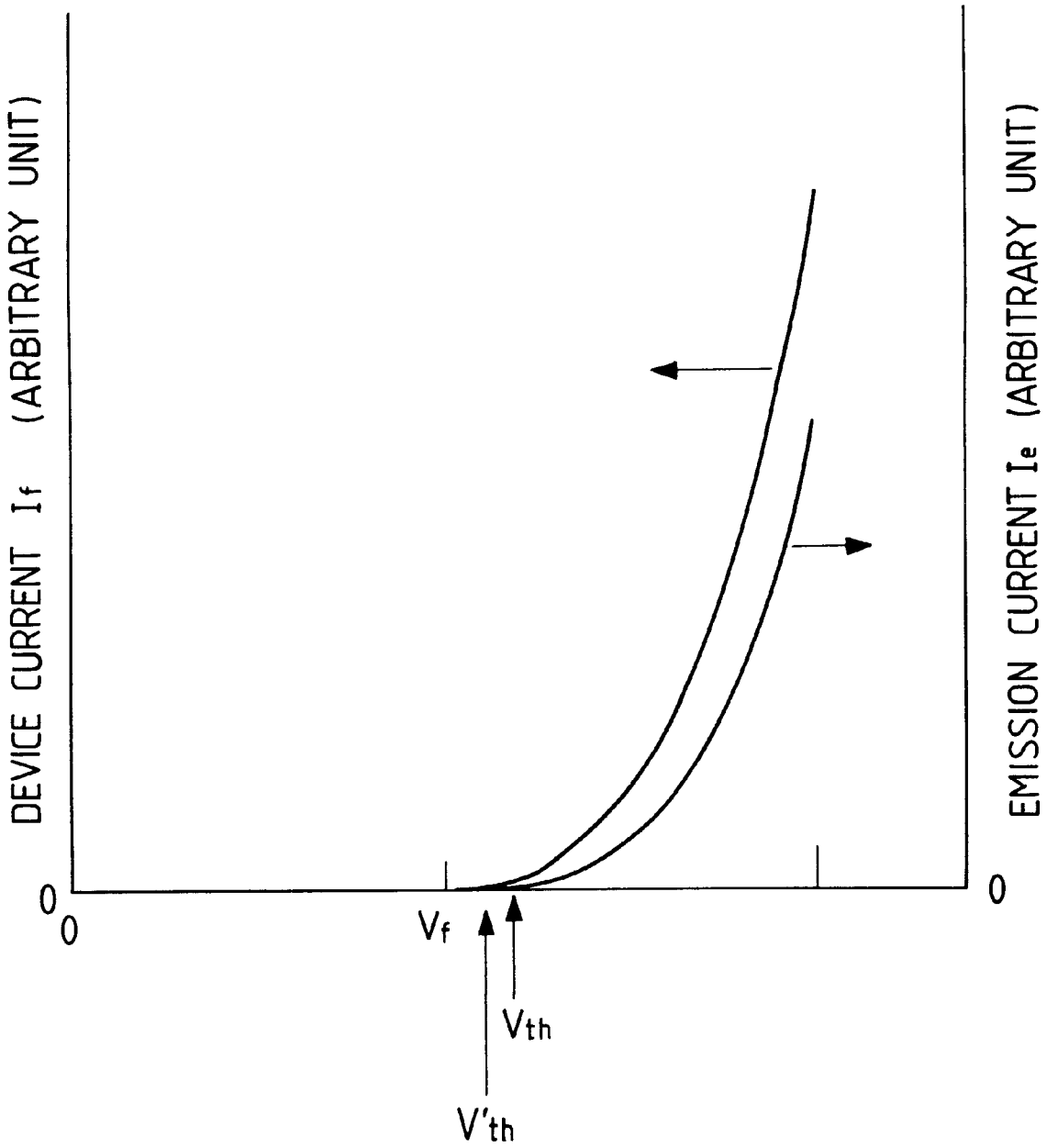
FIG. 20 is a graph illustrating the relationship between the device voltage and the device current and the relationship between the device voltage and the emission current of an electron-emitting device that can be used for an image-forming apparatus according to the invention.

FIG. 20 is a graph schematically illustrating the electron-emitting performance of an electron-emitting device that is free from the above problems and can be used for the purpose of the invention. Referring to FIG. 20, the device current If has a threshold value Vth for the device voltage Vf and the device current If is substantially equal to 0 when the device voltage Vf is lower than the threshold value Vth, whereas it monotonously increases as a function of the device voltage Vf above a threshold value Vth. Thus, the device current is unequivocally defined by the device voltage applied to drive the electron-emitting device for the observation of its performance within the operating voltage range of the device. The emission current Ie again monotonously increases with the device voltage Vf above the threshold value Vth or the former is unequivocally defined by the latter. Note that, in FIG. 20, the device current If and the emission current Ie are shown with arbitrarily selected respective scales because their magnitudes are greatly different from each other, although the scales are both linear scales.

If the partial pressure of the sealed organic substances is too low, the carbonaceous film containing carbon or carbon compound as principal ingredient may be deposited only unsatisfactorily. If, on the other hand, the total pressure in the vacuum envelope including the partial pressure of the organic substances is too high, there arises a risk of electric discharge so that it has to be subjected to an upper limit.

As a result of a series of experiments, it has been found that the partial pressure of the gaseous organic substances in the vacuum envelope should be not lower than $1\times10^{-6}$ Pa. While the upper limit for the total pressure to avoid electric discharge can vary depending on the configuration of the vacuum envelope and the types of the gaseous substances, it is about $1\times10^{-3}$ Pa for an ordinary flat type image-forming apparatus to produce acceptable images when an anode voltage of several kilovolts is applied thereto.

If the stabilization process is performed unsatisfactorily and gaseous organic substances having a short mean absorption time are sealed anew while organic substances having a relatively long mean absorption time are left inside the vacuum envelope, the image-forming apparatus would not obviously be set free from the above identified problems. Therefore, it is indispensable for the purpose of the present invention to eliminate the organic substances existing in the vacuum envelope during the stabilization process. For the purpose of the invention, organic substances having a long mean absorption time refer not only to those introduced into the vacuum envelope for the activation process but also to those unintentionally adsorbed to the inner walls of the vacuum envelope and those undesirably fed into the vacuum envelope from the exhaust system. Thus, the stabilization process should be rigorously conducted, taking these factors into consideration.

The partial pressure of the organic substances left inside the vacuum envelope and having a long mean absorption time after the stabilization process should be lower than the level indicated in the above Japanese Patent Application Laid-Open No. 5-235275 or $1.3\times10^{-6}$ Pa. The atmosphere in the vacuum envelope of the finished image-forming apparatus should also satisfy the above requirement for the partial pressure of organic substances having a long mean absorption time.

The effect of adding hydrogen gas to the above described gaseous organic substances within the vacuum envelope may be explained by the following description. While hydrogen radicals have an effect of etching the carbonaceous film containing carbon or carbon compound as principal ingredient and formed on the electron-emitting region, the organic substances including methane and the like contains hydrogen atoms in each of their molecules so that one or more than one hydrogen radicals can be generated once the bond of the molecule is broken for some reason or other to further etch the carbonaceous film. Particularly, those molecules of the carbonaceous film that are insufficiently polymerized and hence less stable can be etched quickly. As a result, the portions of the carbonaceous film containing carbon or carbon compound as principal ingredient that do not contribute significantly to electron emission and provide paths for leak currents will be preferentially etched to improve the electron-emitting efficiency of the device (because they are poorly energized when the device is driven and carbonized to a low extent and hence can be etched quickly). Take, for example, methane or $CH_4$, of which a single hydrogen bond is broken to produce a hydrogen radical, then carbon and hydrogen provide respective radicals to a ratio of 1:1. (Note that this is a simplified argument because all methane molecules will not necessarily discharge a hydrogen radical.) In the case of ethane, ethylene or acetylene, the number of carbon atoms per molecule is greater than that of methane and hence the carbon to hydrogen radical ratio will be in favor of carbon if compared with methane so that the above described etching effect will be less remarkable with any of these substances. Therefore, hydrogen gas is added in order to raise the number of hydrogen radicals relative to the number of carbon atoms contained in the organic substances and consequently improve the etching effect. Note that, however, while two hydrogen radicals may be produced when the molecular bond is broken in a hydrogen molecule, the bond of the hydrogen molecule or $H_2$ is rather strong and can hardly be broken so that the hydrogen gas will produce hydrogen radicals only to a low extent if compared with the organic substances. In other words, the increase in the number of radicals in the vacuum envelope is not represented by the amount of hydrogen gas introduced into the vacuum envelope and hydrogen gas will have to be introduced somewhat disproportionally in order to realize a significant increase in the number of hydrogen radicals in the vacuum envelope.

Now, the present invention will be described in greater detail by way of preferred embodiments.

Figure 2A:
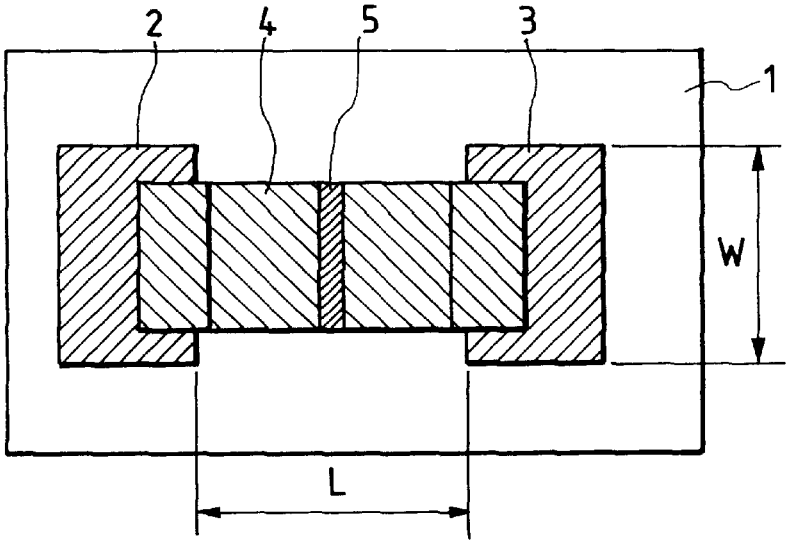
FIGS. 2A, 2B and 2C are schematic views of an electron-emitting device that can be used for the purpose of the invention, schematically illustrating its configuration.
Figure 2B:
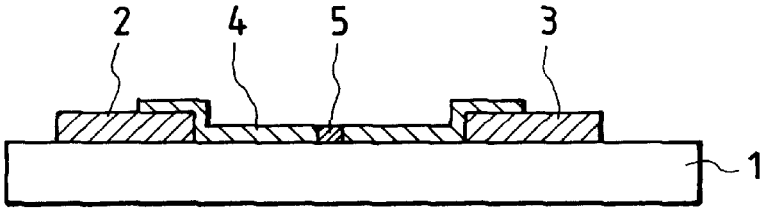
Figure 2C:
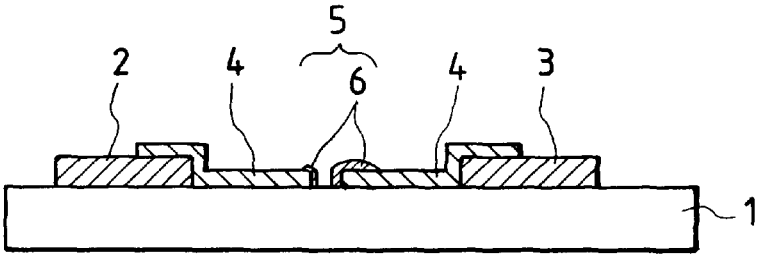

For the purpose of the present invention, a number of surface conduction electron-emitting devices having a configuration as shown in FIGS. 2A through 2C are formed on a substrate to produce an electron source.

Electron-emitting devices may be arranged on a substrate in a number of different modes.

For instance, a number of electron-emitting devices may be arranged in parallel rows along a direction (hereinafter referred to row-direction), each device being connected by wires as at opposite ends thereof, and driven to operate by control electrodes (also referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along an X-direction and columns along an Y-direction to form a matrix, the X- and Y-directions being perpendicular to each other, and the electron-emitting devices on a same row are connected to a common X-directional wire by way of one of the electrodes of each device while the electron-emitting devices on a same column are connected to a common Y-directional wire by way of the other electrode of each device. The latter arrangement is referred to as a simple matrix arrangement.

Figure 3:
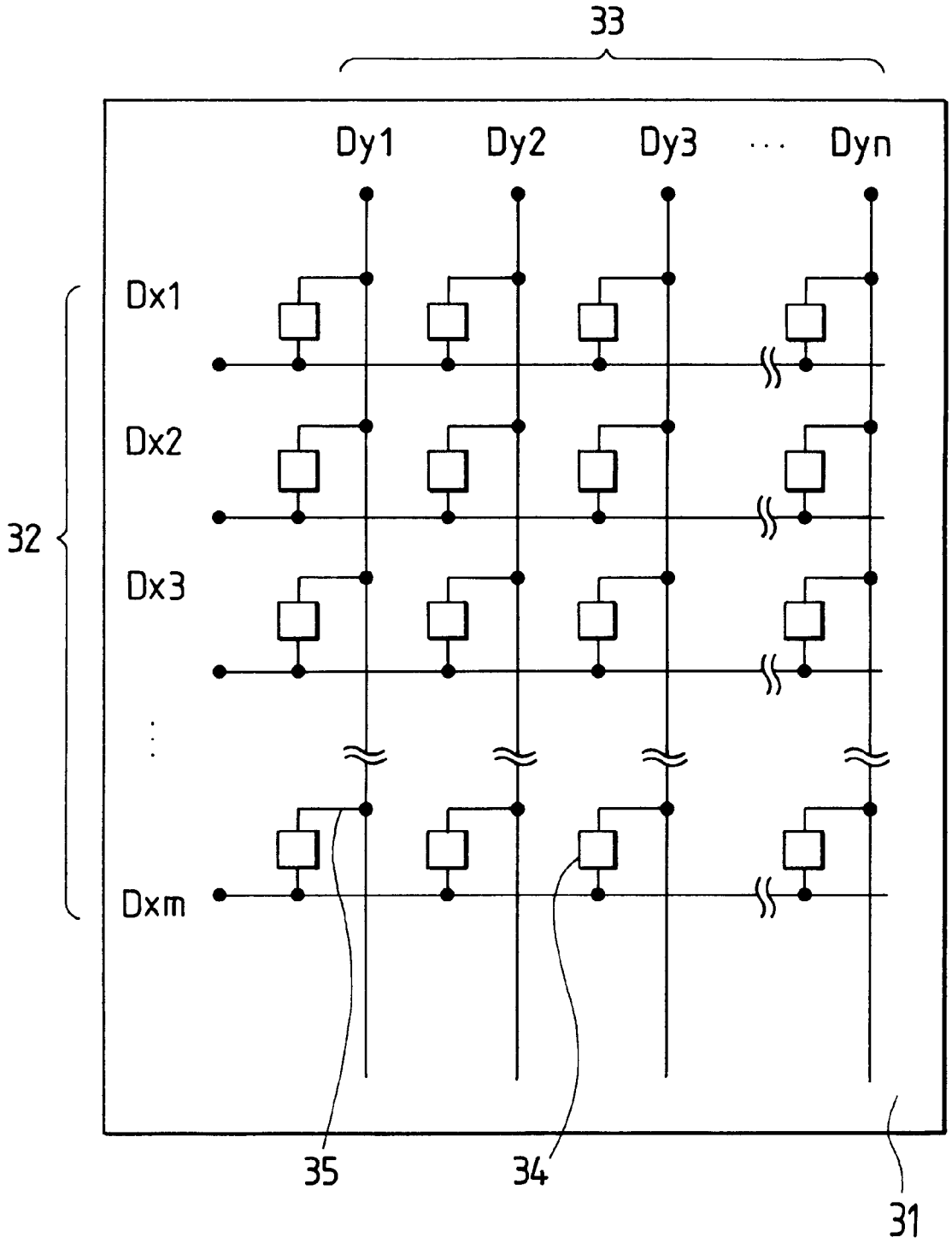
FIG. 3 is a schematic illustration of a wiring arrangement (matrix wiring) for an electron source that can be used for the purpose of the invention.

Firstly, an image-forming apparatus comprising an electron source with a simple matrix arrangement can be prepared in a manner as described below. FIG. 3 is a schematic illustration of an electron source having a simple matrix arrangement. Referring to FIG. 3, the electron source comprises an electron source substrate 31, X-directional wires 32 and Y-directional wires 33 along with surface conduction electron-emitting devices 34 and connecting wires 35.

There are provided a total of m X-directional wires 32, which are donated by Dx1, Dx2, . . . , Dxm and made of an electroconductive metal produced by vacuum deposition, printing or sputtering. These wires are appropriately and carefully designed in terms of material, thickness and width. A total of n Y-directional wires 33 are arranged and donated by Dy1, Dy2, . . . , Dyn, which are similar to the X-directional wires 32 in terms of material, thickness and width. An interlayer insulation layer (not shown) is disposed between the m X-directional wires 32 and the n Y-directional wires 33 to electrically isolate them from each other. (Both m and n are integers.)

The interlayer insulation layer (not shown) is typically made of $SiO_2$ by means of vacuum deposition, printing or sputtering. For example, it may be formed on the entire surface or part of the surface of the substrate 31 on which the X-directional wires 32 have been formed to show a desired profile. The thickness, material and manufacturing method of the interlayer insulation layer are so selected as to make it withstand the potential difference between any of the X-directional wires 32 and any of the Y-directional wires 33 observable at the crossing thereof. Each of the X-directional wires 32 and the Y-directional wires 33 is drawn out to form an external terminal.

The oppositely arranged paired electrodes (not shown) of each of the surface conduction electron-emitting devices 34 are connected to related one of the m X-directional wires 32 and related one of the n Y-directional wires 33 by respective connecting wires 35 which are made of an electroconductive metal.

The electroconductive metal material of the device electrodes and that of the connecting wires 35 extending from the wire 32 and 33 may be same or contain a common element as an ingredient. Alternatively, they may be different from each other. These materials may be appropriately selected typically from candidate materials for the device electrodes. If the device electrodes and the connecting wires are made of a same material, they may be collectively called device electrodes without discriminating the connecting wires.

The X-directional wires 32 are electrically connected to a scan signal application means (not shown) for applying a scan signal to a selected row of surface conduction electron-emitting devices 34. On the other hand, the Y-directional wires 33 are electrically connected to a modulation signal generation means (not shown) for applying a modulation signal to a selected column of surface conduction electron-emitting devices 34 and modulating the selected column according to an input signal. Note that the drive signal to be applied to each surface conduction electron-emitting device is expressed as the voltage difference of the scan signal and the modulation signal applied to the device.

Figure 4:
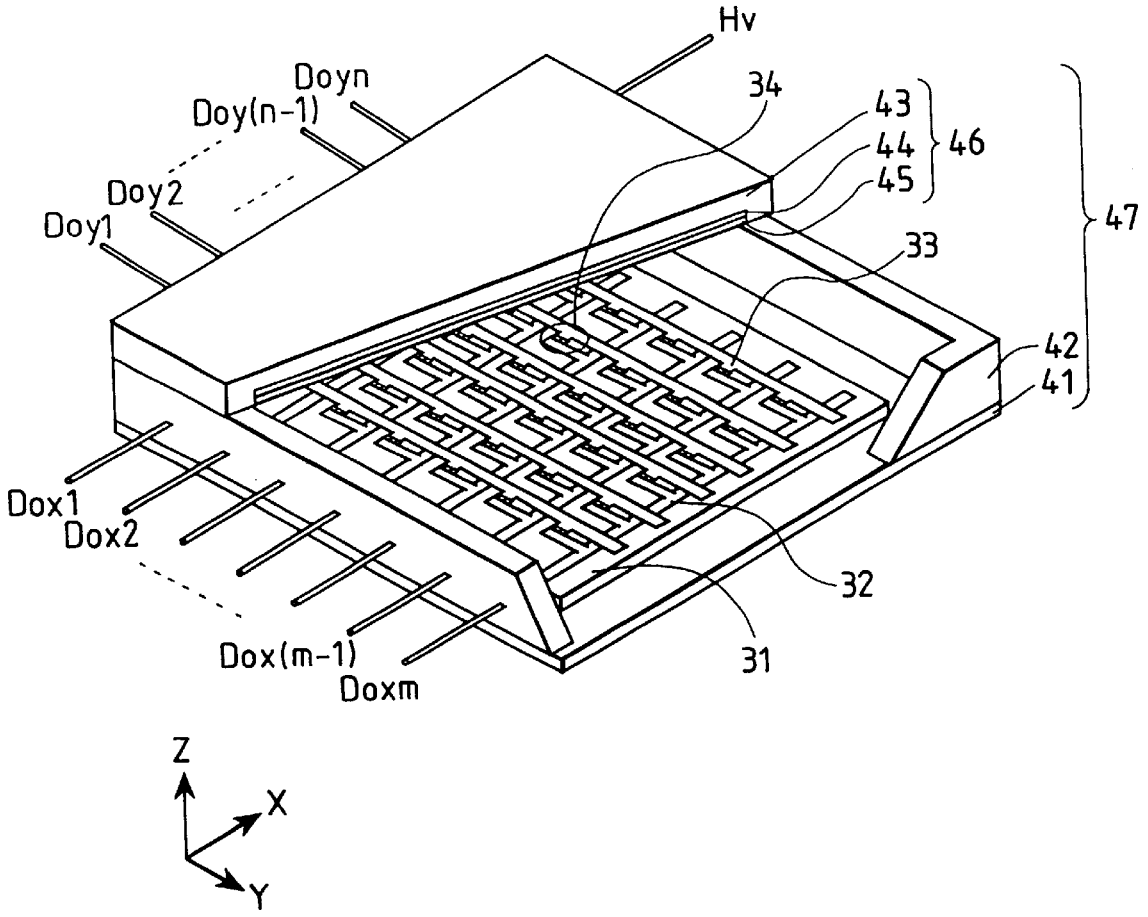
FIG. 4 is a schematic perspective view of an image-forming apparatus according to the invention and comprising an electron source having a matrix-wiring arrangement.
Figure 5A:
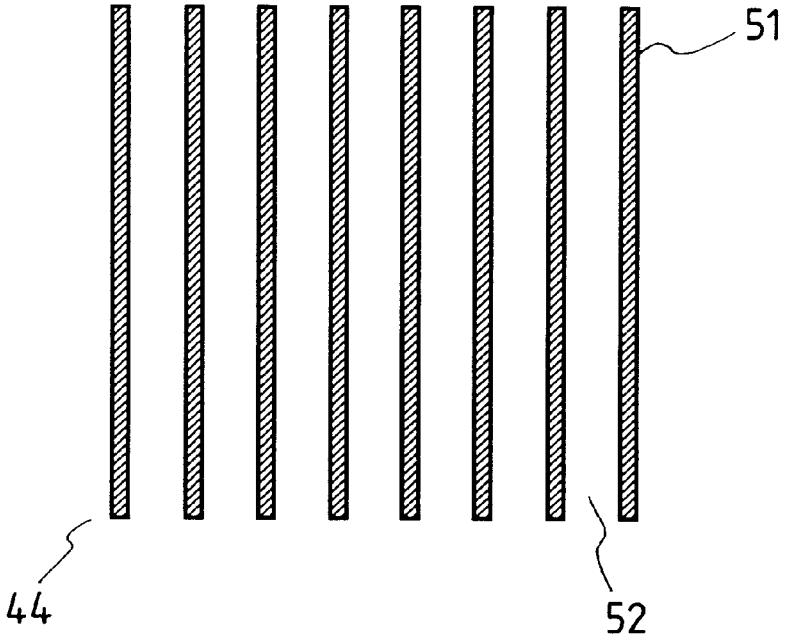
FIGS. 5A and 5B are two possible designs of fluorescent film that can be used for an image-forming apparatus according to the invention.
Figure 5B:
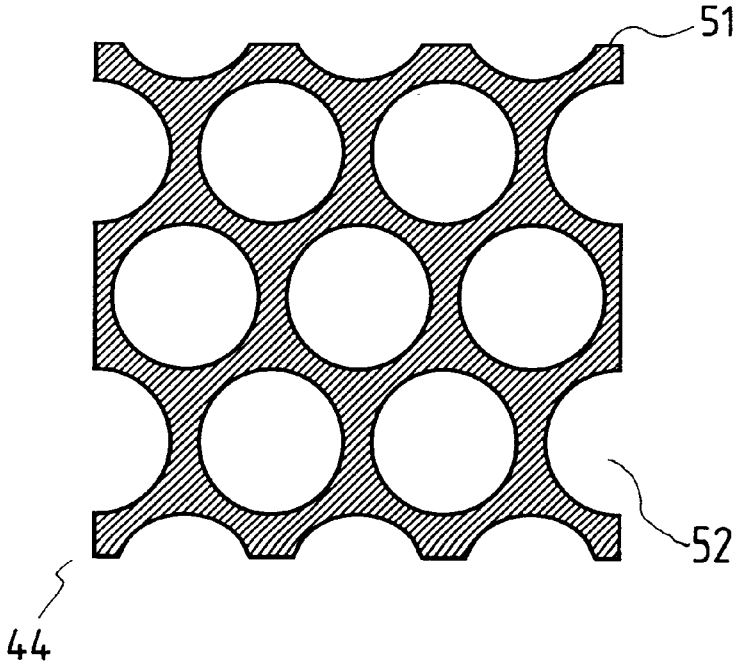

Now, an image-forming apparatus comprising an electron source having a simple matrix arrangement as described above will be described by referring to FIGS. 4, 5A, 5B and 6. FIG. 4 is a partially cut away schematic perspective view of the image forming apparatus and FIGS. 5A and 5B show two possible configurations of a fluorescent film that can be used for the image forming apparatus of FIG. 4.

Referring firstly to FIG. 4 illustrating the basic configuration of the display panel of the image-forming apparatus, it comprises an electron source substrate 31 of the above described type carrying thereon a plurality of electron-emitting devices, a rear plate 41 rigidly holding the electron source substrate 31, a face plate 46 prepared by laying a fluorescent film 44 and a metal back 45 on the inner surface of a glass substrate 43 and a support frame 42, to which the rear plate 41 and the face plate 46 are bonded by means of frit glass having a low melting point.

X-directional wires 32 and Y-directional wires 33 are arranged to electrically connect the paired device electrodes of the surface conduction electron-emitting devices 34.

While the electron source comprises a vacuum envelope 47 that is formed of a face plate 46, a support frame 42 and a rear plate 41 as described above, the rear plate 41 may be omitted if the substrate 31 is strong enough by itself because the rear plate 41 is provided mainly for reinforcing the substrate 31. If such is the case, an independent rear plate 41 may not be required and the substrate 31 may be directly bonded to the support frame 42 so that the vacuum envelope 47 is constituted of a face plate 46, a support frame 42 and a substrate 31. The overall strength of the envelope 47 against the atmospheric pressure may be increased by arranging a number of support members called spacers (not shown) between the face plate 46 and the rear plate 41.

FIGS. 5A and 5B illustrate two possible configurations of fluorescent film that can be used for the purpose of the invention. While the fluorescent film 44 may comprise only a single fluorescent body if the display panel is used for showing black and white pictures, it needs to comprise for displaying color pictures black conductive members 51 and fluorescent bodies 52, of which the former are referred to as black stripes or members of a black matrix depending on the arrangement of the fluorescent bodies. Black stripes or members of a black matrix are arranged for a color display panel so that the fluorescent bodies 52 of three different primary colors are made less discriminable and the adverse effect of reducing the contrast of displayed images of external light reflected by the fluorescent film 44 is weakened by blackening the surrounding areas. While graphite is normally used as principal ingredient of the black stripes, other conductive material having low light transmissivity and reflectivity may alternatively be used.

A precipitation or printing technique is suitably be used for applying a fluorescent material on the glass substrate 43 regardless of black and white or color display. An ordinary metal back 45 is arranged on the inner surface of the fluorescent film 44. The metal back 45 is provided in order to enhance the luminance of the display panel by causing the rays of light emitted from the fluorescent bodies and directed to the inside of the envelope to turn back toward the face plate 46, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum deposition after forming the fluorescent film.

A transparent electrode (not shown) may be formed on the face plate 46 facing the outer surface of the fluorescent film 44 in order to raise the conductivity of the fluorescent film 44.

Care should be taken to accurately align each set of color fluorescent bodies and an electron-emitting device, if a color display is involved, before the above listed components of the envelope are bonded together.

An image-forming apparatus as illustrated in FIG. 4 can be prepared in a manner as described below.

Figure 6:
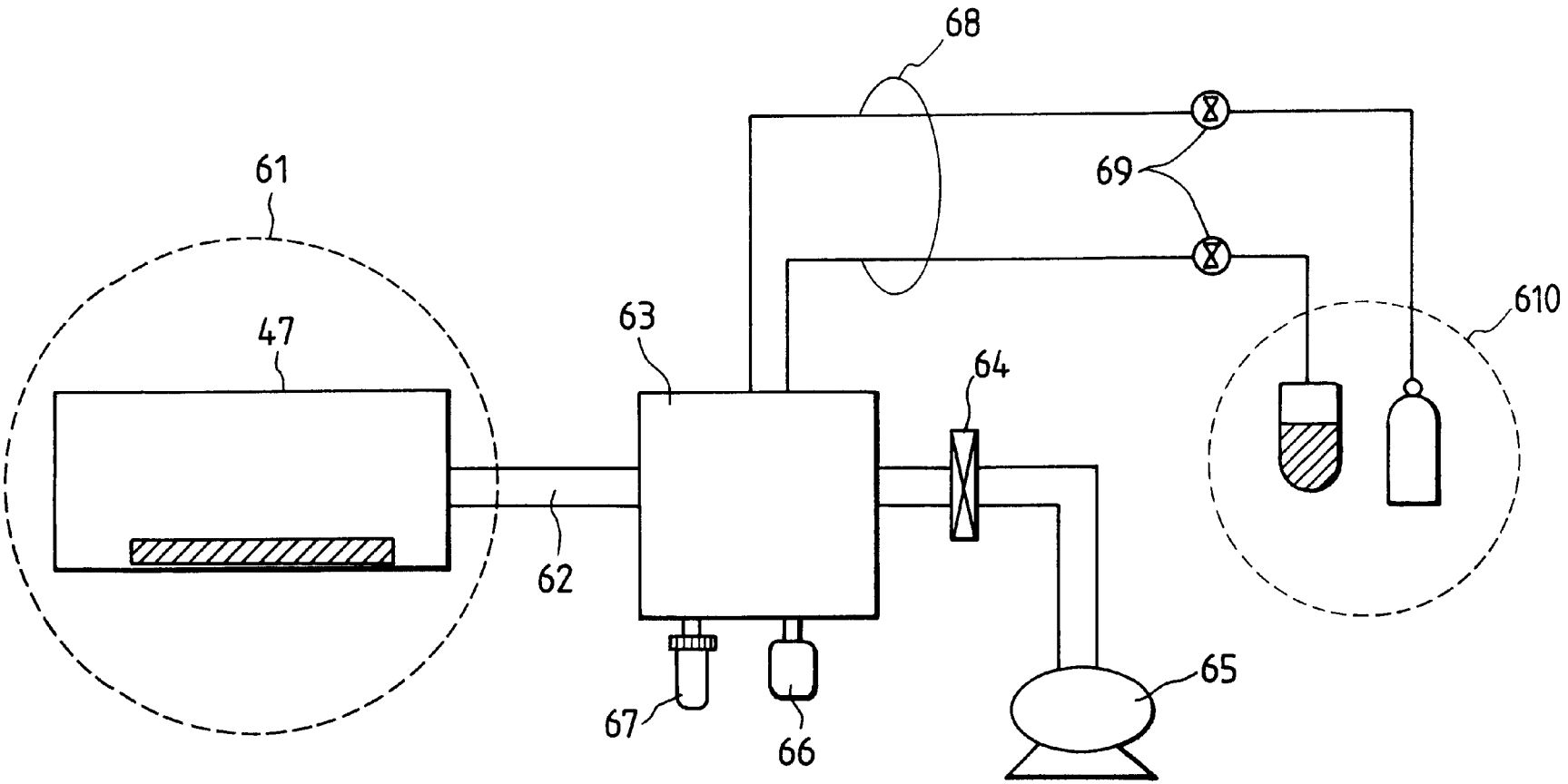
FIG. 6 is a schematic diagram of a system to be used for the activation process in the manufacture of an image-forming apparatus according to the invention.
Figure 7:
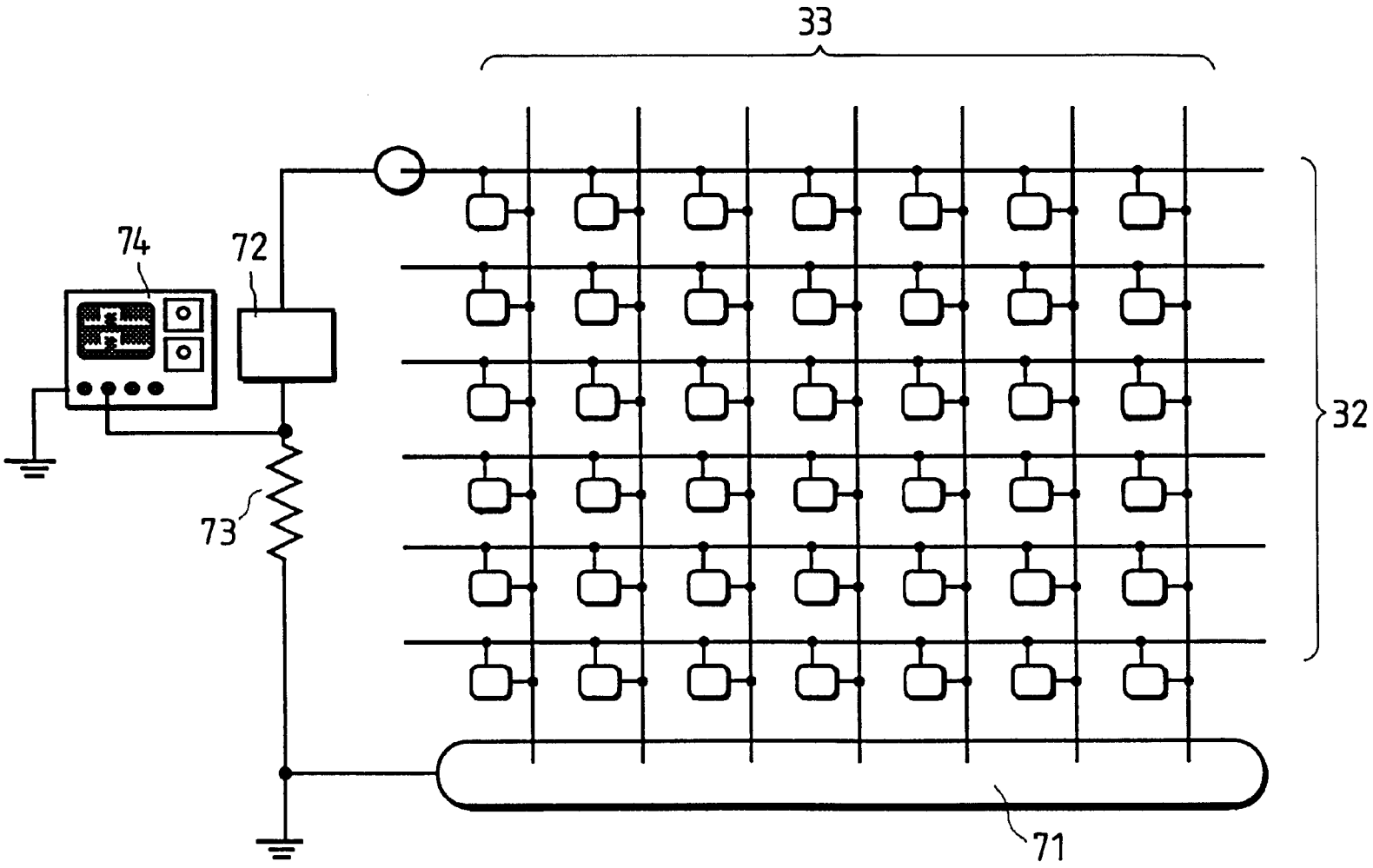
FIG. 7 is a schematic illustration of an electron source arranged for an energization forming process in the manufacture of an image-forming apparatus according to the invention.

FIG. 6 is a schematic diagram of a system to be used for finish an image-forming apparatus. Referring to FIG. 6, the image-forming apparatus 61 is connected to a vacuum chamber 63 by way of an exhaust pipe 62 and then further to an exhaust system 65 by way of a gate valve 64. The vacuum chamber 63 is provided with a pressure gauge 66, a quadrupole mass spectrometer 67 and other elements for measuring the internal pressure and the partial pressures of the individual gaseous substances contained in the atmosphere. Since it is difficult to directly measure the internal pressure of the vacuum envelope 47 of the image-forming apparatus 61, the conditions for the system are controlled by observing the internal pressure of the vacuum chamber 63 and other measurable pressures.

The vacuum chamber 63 is further connected to a gas feed line 68 for feeding gas necessary for controlling the atmosphere in the vacuum chamber. The other end of the gas feed line 68 is connected to a substance source 610 storing substances to be supplied to the vacuum chamber in respective ampules and/or tanks. Feed control means 69 are arranged on the gas feed line for controlling the rates at which the respective substances are fed to the vacuum chamber. The feed control means 69 may include valves such as slow leak valves for controlling the flow rate of the substances to be discharged and mass flow controllers depending on the substances stored in the substance source.

The inside of the vacuum envelope 47 is evacuated by means of the system illustrated in FIG. 6 and the electron-emitting devices in the envelope are subjected to an energization forming process, where the Y-directional wires 33 are connected to a common electrode 71 and a pulse voltage is applied to the devices on each of the X-directional wires 32 by means of a power source 72.

Alternatively, the energization forming process can be conducted collectively on the devices connected to a plurality of X-directional wires by sequentially applying voltages having shifted phases to the respective X-directional wires (an operation referred to as scrolling). In FIG. 6, reference numeral 73 denotes a resistor for measuring the electric current and reference numeral 74 denotes an oscilloscope for measuring the electric current.

An activation process follows the energization forming process. In the activation process, the vacuum envelope 47 is thoroughly evacuated and then organic substances are introduced into it by way of the gas feed line 68. Organic substances having a long mean absorption time cannot appropriately be used for this process. The organic substances have to be satisfactorily removed in a succeeding stabilization process as will be described hereinafter but they cannot be properly removed in the stabilization process if they have a long mean absorption time. Organic substances that can desirably used in the activation process include methane, ethane, ethylene, acetylene, propylene, butadiene, n-hexane, benzene, nitrobenzene, toluene, o-xylene, benzonitrile, chloroethylene, trichloroethylene, methanol, ethanol, isopropanol, ethylene glycol and acetone. The adverse effect of residual organic substances can be avoided if organic substances same as those used in a subsequent gas feeding step are selected for this activation process. The use of such organic substances is advantageous because they typically have a short mean absorption time and can be removed from the vacuum envelope relatively easily. If necessary, substances other than organic substances may also be introduced into the vacuum envelope in this activation process. Then, a pulse voltage is applied to each of the electron-emitting devices in an atmosphere containing the organic substances until a carbonaceous film containing carbon or carbon compound as principal ingredient is formed by deposition on the electron-emitting region of the electron-emitting device to dramatically increase the rate of electron emission of the device. The pulse voltage may be applied simultaneously to all the devices connected to a single directional wire as in the case of the energization forming process.

After the completion of the activation process, the electron-emitting devices are subjected to a stabilization process.

In the stabilization process, the vacuum envelope 47 is evacuated by way of the exhaust pipe 62, using an oil free exhaust system 65 typically comprising an ion pump and a sorption pump, while heating and maintaining the vacuum envelope 47 to 80° C. to 250° C., to produce an atmosphere sufficiently free from organic substances in the inside. If organic substances having a long mean absorption time are not satisfactorily removed and left inside to a considerably concentration by this process, the electron-emitting devices will operate unstably and become unsuited for the purpose of the invention. The partial pressure of such organic substances should be reduced to not higher than $1.0\times10^{-6}$ Pa in this process as described earlier.

Since water has a relatively long mean absorption time on the order of milliseconds, it can take a considerably long time for the moisture in the vacuum envelope to be satisfactorily removed. As the inside of the vacuum envelope is evacuated to reduce the internal pressure, moisture can often take a large proportion in the residual gas when the internal pressure is found between $10^{-3}$ and $10^{-6}$ Pa. If a mixture gas of organic substances with or without hydrogen is introduced into the vacuum envelope to produce a desired pressure in the subsequent gas feeding step under the condition where the vacuum envelope contains such residual gas, it will be difficult to precisely control the amount of mixture gas to be fed into the vacuum envelope. Therefore, it is desirably to evacuate the vacuum envelope thoroughly in the stabilization step until the internal pressure of the vacuum envelope falls under $1.0\times10^{-6}$ Pa including the partial pressure of the organic substances having a long mean absorption time.

Subsequently, a process of introducing a mixture gas of organic substances with or without hydrogen is carried out and then the vacuum envelope is hermetically sealed by heating and melting the exhaust pipe by means of a burner. A getter process may be conducted in order to maintain the achieved degree of vacuum in the inside of the vacuum envelope 47 after it exists. In a getter process, a getter arranged at a predetermined position (not shown) in the vacuum envelope 47 is heated by means of a resistance heater or a high frequency heater to form a film by evaporation immediately before or after the vacuum envelope 47 exists. A getter typically contains Ba as a principal ingredient and can maintain a low pressure atmosphere in the vacuum envelope 47 by removing moisture and oxygen discharged from the walls of the sealed vacuum envelope by the adsorption effect of the film formed by evaporation.

Now, an electron source comprising a plurality of surface conduction electron-emitting devices arranged in a ladder-like manner on a substrate and an image-forming apparatus comprising such an electron source will be described by referring to FIGS. 8 and 9.

Figure 8:
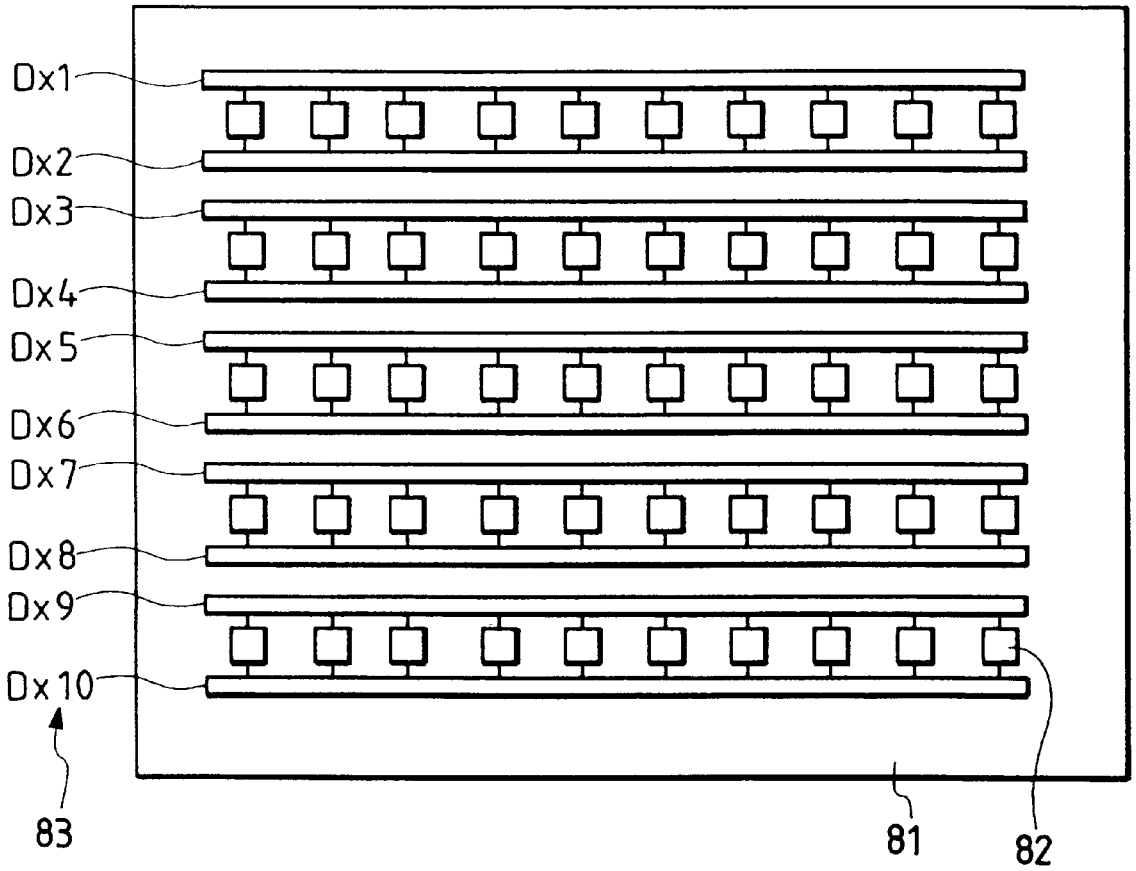
FIG. 8 is a schematic illustration of another wiring arrangement (ladder-type-wiring) for an electron source that can be used for the purpose of the invention.

Firstly referring to FIG. 8 schematically shows an electron source having a ladder-like arrangement, reference numeral 81 denotes an electron source substrate and reference numeral 82 denotes each of the surface conduction electron-emitting devices arranged on the substrate, whereas reference numeral 83 denotes common wires for connecting the surface conduction electron-emitting devices and by turn provided with respective external terminals Dx1 through Dx10. The electron-emitting devices 82 are arranged in rows (to be referred to as device rows hereinafter) on the substrate 81 along the X-direction to form an electron source comprising a plurality of device rows, each row having a plurality of devices. The surface conduction electron-emitting devices of each device row are electrically connected in parallel with each other by a pair of common wires so that the devices of each device row can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two adjacently located device rows can share a single common wire. Thus, for example, of the common wires Dx2 through Dx9 for the device rows, a single wire may be used for Dx2 and Dx3 and so on.

Figure 9:
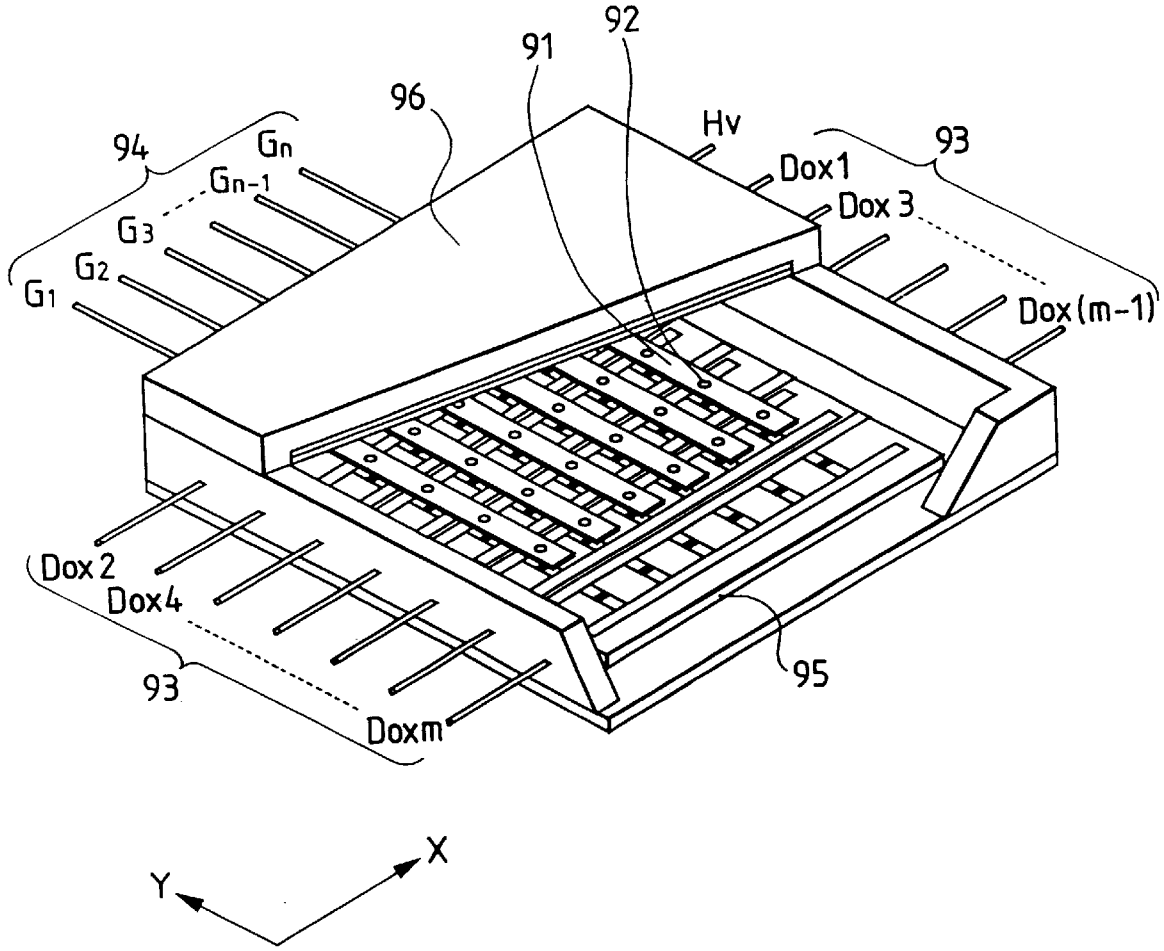
FIG. 9 is a schematic perspective view of an image-forming apparatus according to the invention and comprising an electron source having a ladder-type-wiring arrangement.

FIG. 9 is a schematic perspective view of the display panel of an image-forming apparatus incorporating an electron source having a ladder-like arrangement of electron-emitting devices. In FIG. 9, the display panel comprises grid electrodes 91, each provided with a number of bores 92 for allowing electrons to pass therethrough and a set of external terminals Dox1, Dox2, . . . , Doxm collectively denoted by reference numeral 93, along with another set of external terminals G1, G2, . . . , Gn, connected to the respective grid electrodes 91 and collectively denoted by reference numeral 94. Reference numerals 95 and 96 respectively denote a substrate and a face plate.

The display panel of FIG. 9 differs from the display panel comprising an electron source with a simple matrix arrangement of FIG. 4 mainly in that the apparatus of FIG. 9 has grid electrodes 91 arranged between the substrate 95 and the face plate 96.

In FIG. 9, the stripe-shaped grid electrodes 91 are arranged between the substrate 95 and the face plate 96 perpendicularly relative to the ladder-like device rows for modulating electron beams emitted from the surface conduction electron-emitting devices, each provided with through bores 92 in correspondence to respective electron-emitting devices for allowing electron beams to pass therethrough. Note that, however, while stripe-shaped grid electrodes are shown in FIG. 9, the profile and the locations of the electrodes are not limited thereto. For example, the grid electrodes may alternatively be provided with mesh-like openings and arranged around or close to the surface conduction electron-emitting devices.

The external terminals 93 and the external terminals 94 for the grids are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

The driving frequency for usual TV set (NTSC, PAL etc.) is 30 Hz corresponding to driving period of about 33 millisecond, and that for display devices for computer terminal units is about 60 Hz corresponding to driving period of about 16.7 millisecond. So the mean absorption time of the gaseous organic substances existing in the vacuum envelope being shorter than them is available for the TV set and the display devices for computer terminal units, if the brightness gradation is realized by pulse width modulation or pulse wave height modulation. Thus, the gaseous organic substances to be sealed in the vacuum envelope have to be selected in such a way that the organic substances show a mean absorption time shorter than the drive period.

The brightness gradation can be realized by modulating the number of times for which a pulse voltage having a predetermined pulse wave height and a predetermined short pulse width with a predetermined period of time. In this case, while the drive period may be as short as several microseconds but still is feasible for the purpose of the invention because the mean absorption time of methane, ethylene and/or acetylene is sufficiently short as described earlier.

Now, the present invention will be described by way of examples. However, it should be noted that the present invention is not limited thereto and they are subject to changes and modifications in terms of individual components and the entire design without departing from the scope of the invention.

EXAMPLE 1

Figure 10:
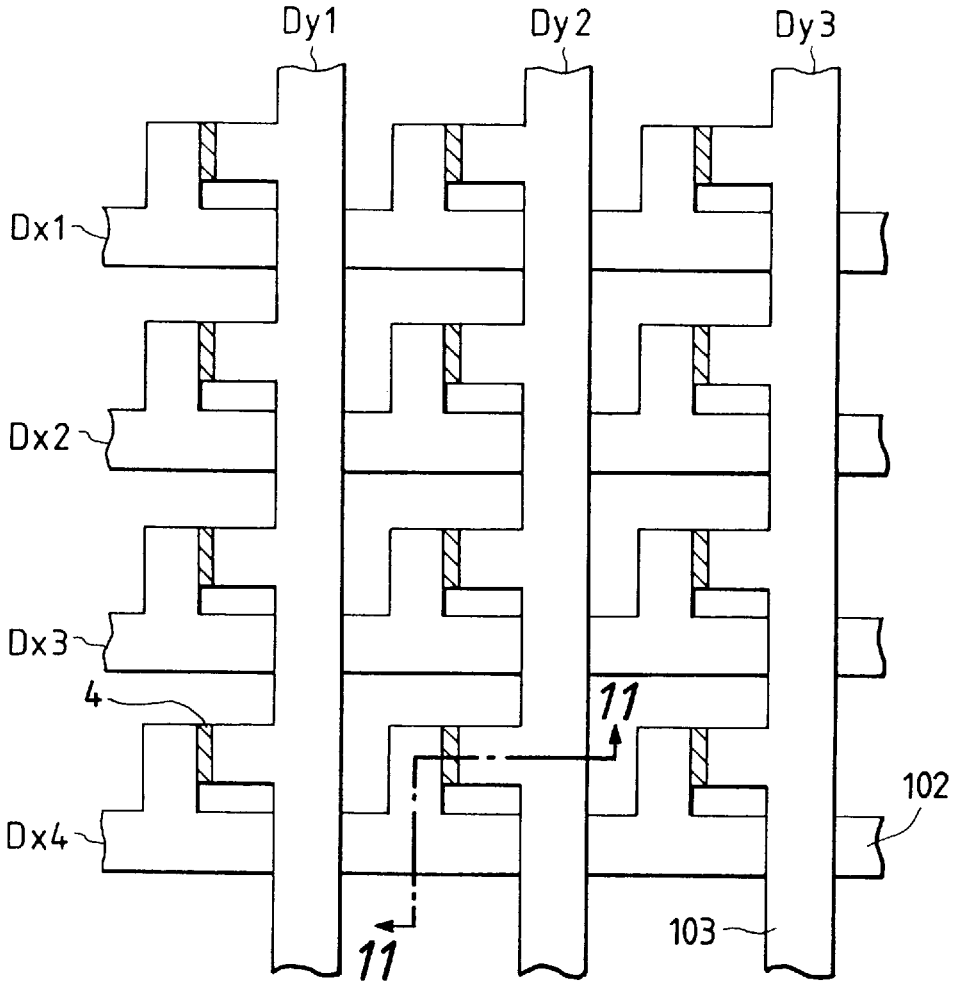
FIG. 10 is a schematic partial plan view of an electron source with a matrix-wiring arrangement.
Figure 11:
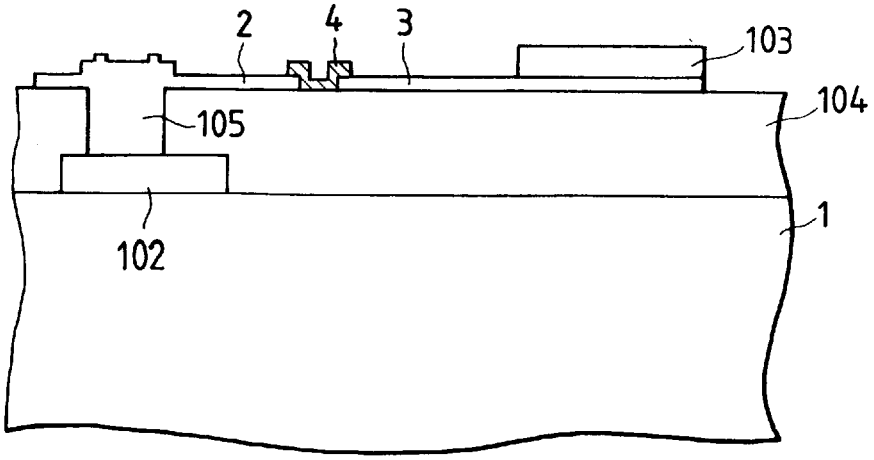
FIG. 11 is a schematic cross sectional view of the electron source of FIG. 10 taken along line 11—11.
Figure 12A:
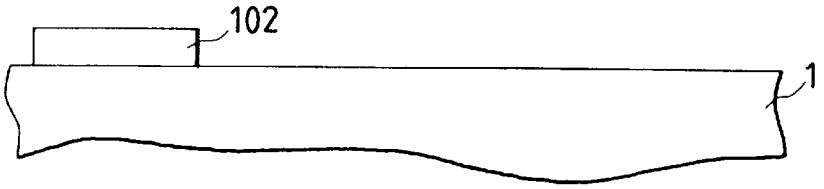
FIGS. 12A, 12B, 12C, 12D, 12E, 12F, 12G and 12H are schematic partial sectional views of an electron source with a matrix-wiring arrangement that can be used for the purpose of the invention, illustrating different manufacturing steps.
Figure 12B:
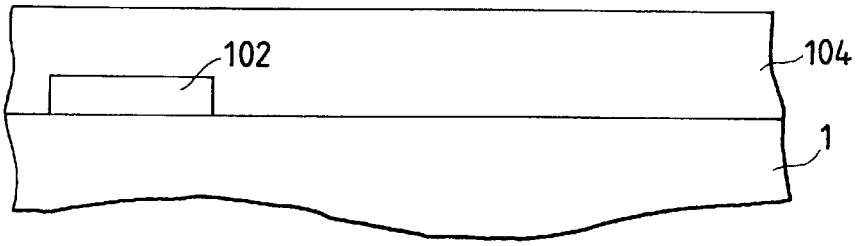
Figure 12C:
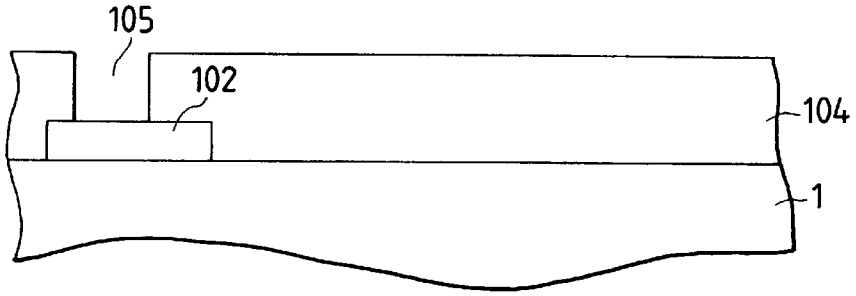
Figure 12D:
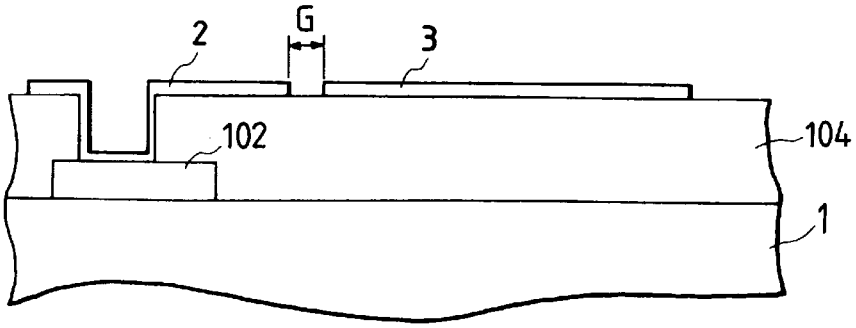
Figure 12E:
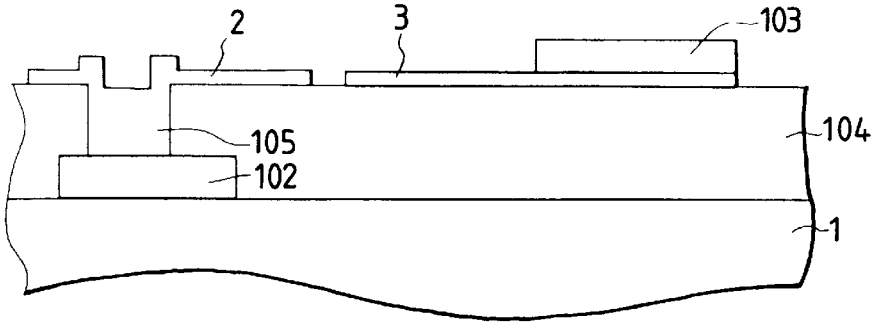
Figure 12F:
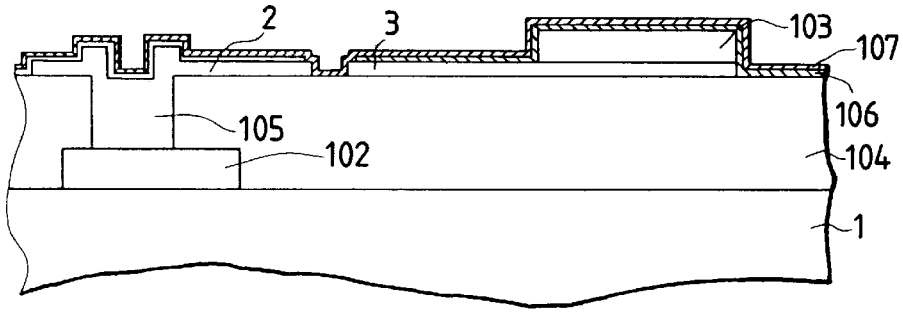
Figure 12G:
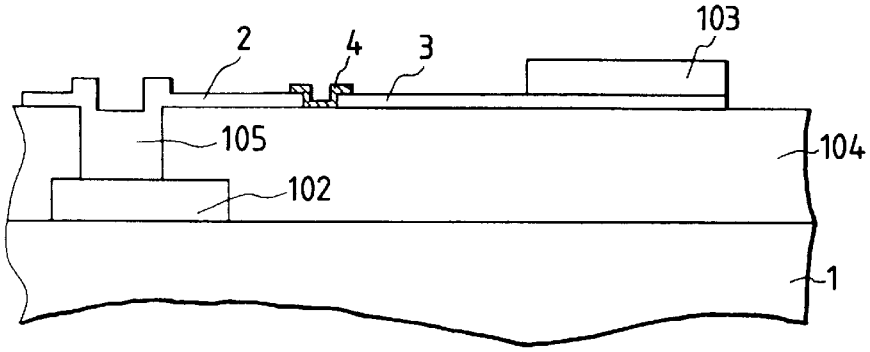
Figure 12H:
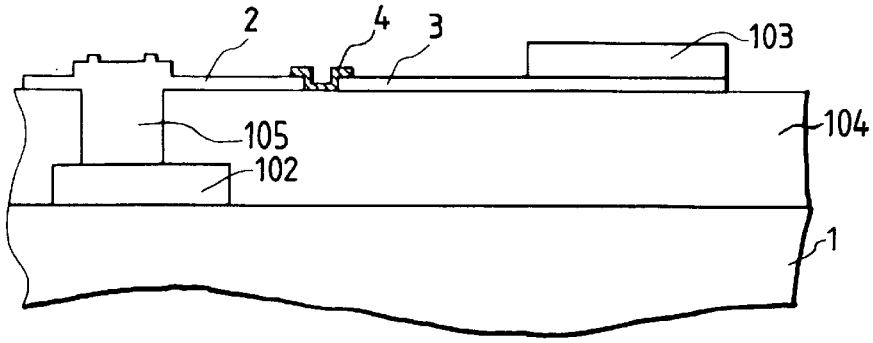

In this example, an image-forming apparatus comprising electron source realized by arranging a large number of surface conduction electron-emitting devices arranged on a substrate and provided with a simple matrix wiring arrangement was prepared. FIG. 10 is a partial plan view of the electron source prepared in these examples. FIG. 11 is a cross sectional view taken along line 11—11 in FIG. 10.

In FIGS. 10 and 11, 1 denotes a substrate and 102 and 103 respectively denotes an X-directional wire (lower wire) and a Y-directional wire (upper wire). Otherwise, there are shown device electrodes 2 and 3, an electroconductive thin film 4 including an electron-emitting region, an interlayer insulation layer 104 and a contact hole 105 for electrically connecting the device electrode 2 and the lower wire 102. Now, the method used for manufacturing the electron source will be described in terms of an electron-emitting device thereof by referring to FIGS. 12A through 12H. Note that the following manufacturing steps, or Step A through Step H, respectively correspond to FIGS. 12A through 12H.

(Step A)

After thoroughly cleansing a soda lime glass plate, a silicon oxide film was formed thereon to a thickness of 0.5 $\mu$m by sputtering to produce a substrate 1, on which Cr and Au were sequentially laid to thicknesses of 5 nm and 600 nm respectively and then a photoresist (AZ1370: available from Hoechst Corporation) was formed thereon by means of a spinner, and baked. Thereafter, a photo-mask image was exposed to light and photochemically developed to produce a resist pattern for a lower wire 102 and then the deposited Au/Cr film was wet-etched to actually produce a lower wire 102 having a desired profile.

(Step B)

A silicon oxide film was formed as an interlayer insulation layer 104 to a thickness of 1.0 $\mu$m by RF sputtering.

(Step C)

A photoresist pattern was prepared for producing a contact hole 105 in the silicon oxide film deposited in Step B, which contact hole 105 was then actually formed by etching the interlayer insulation layer 104, using the photoresist pattern for a mask. A technique of RIE (Reactive Ion Etching) using $CF_4$ and $H_2$ gas was employed for the etching operation.

(Step D)

Thereafter, a pattern of photoresist (RD-2000N-41: available from Hitachi Chemical Co., Ltd.) was formed for a pair of device electrodes 2 and 3 and the gap G separating the device electrodes and then Ti and Ni were sequentially deposited thereon respectively to thicknesses of 5 nm and 100 nm by vacuum deposition. The photoresist pattern was dissolved into an organic solvent and the Ni/Ti deposit film was treated by using a lift-off technique to produce a pair of device electrodes 2 and 3 separated by a gap of 3 $\mu$m and having a width of 300 $\mu$m.

(Step E)

A photoresist pattern was prepared for upper wire 103 on the device electrodes 2 and 3 and Ti and Au were sequentially deposited by vacuum deposition to respective thicknesses of 5 nm and 500 nm. All the unnecessary portions of the photoresist was removed to produce an upper wire 103 having a desired profile by means of a lift-off technique.

(Step F)

Then, a Cr film 106 was formed to a film thickness of 300 nm by vacuum deposition and patterned to produce a desired profile by using a mask having an opening for the contour of the electroconductive film 4. A solution of a Pd amine complex (ccp4230: available from Okuno Pharmaceutical Co., Ltd.) was applied onto the Cr film by means of a spinner and baked at 300° C. for 12 minutes to produce an electroconductive thin film 107 made of PdO fine particles and having a film thickness of 70 nm.

(Step G)

The Cr film 106 was removed along with any unnecessary portions of the electroconductive film 107 of PdO fine particles by wet etching, using an etchant to produce a pattern having a desired profile. The electroconductive thin film 4 showed an electric resistance of $Rs=4\times10^4$ Ω/□ or so.

(Step H)

Resist was applied to the entire surface except the contact hole 105 to form a resist pattern and Ti and Au were sequentially deposited to respective thicknesses of 5 nm and 500 nm. Then, any unnecessary areas were removed by means of a lift-off technique to bury the contact hole.

Then, the prepared electron source was used to prepare an image-forming apparatus.

Referring again to FIG. 4, after securing an electron source substrate 31 onto a rear plate 41, a face plate 46 (carrying a fluorescent film 44 and a metal back 45 on the inner surface of a glass substrate 43) was arranged with a support frame 42 disposed therebetween and, subsequently, frit glass was applied to the contact areas of the face plate 46, the support frame 42 and the rear plate 41 and baked at 400° C. in the atmosphere for 10 minutes to hermetically seal the container. The substrate 31 was also secured to the rear plate 41 by means of frit glass. The substrate 31 and the face plate 46 were separated by a gap of 5 mm.

While the fluorescent film 44 is consisted only of a fluorescent body if the apparatus is for black and white images, the fluorescent film 44 of this example was prepared by forming black stripes in the first place and filling the gaps with stripe-shaped fluorescent bodies of primary colors. The black stripes were made of a popular material containing graphite as a principal ingredient. A slurry technique was used for applying fluorescent materials onto the glass substrate 43.

A metal back 45 is arranged on the inner surface of the fluorescent film 44. After preparing the fluorescent film 44, the metal back 45 was prepared by carrying out a smoothing operation (normally referred to as "filming") on the inner surface of the fluorescent film 44 and thereafter forming thereon an aluminum layer by vacuum deposition.

While a transparent electrode may be arranged on the face plate 46 on the out side of the fluorescent film 44 in order to enhance the electroconductivity of the fluorescent film 44, no such transparent electrode was used in this example because the metal back 45 provided a sufficient electroconductivity.

For the above bonding operation, the components were carefully aligned in order to ensure an accurate positional correspondence between the color fluorescent members 122 and the electron-emitting devices 104.

The image forming apparatus was then connected to a vacuum system as shown in FIG. 6 and the vacuum chamber was evacuated by way of an exhaust pipe to reduce the internal pressure to about $10^{-4}$ Pa. Then, an energization forming process was conducted by connecting the Y-directional wires 33 to a common electrode 71 on a line-by-line basis in the X-direction. The employed pulse voltage was a triangular pulse having a pulse width of 1 msec. and a pulse interval of 10 msec. The pulse wave height of the voltage was increased gradually.

After all the lines were subjected to energization forming, an activation process was carried out.

In this process, n-hexane was introduced into the vacuum envelope until the pressure rose to $2.7\times10^{-2}$ Pa. A pulse voltage having a pulse width and a pulse interval same those of the one used for the energization forming process was applied to the device for activation, observing the device current If and the emission current Ie. The pulse wave height was fixed to 15V.

After the activation process, a stabilizing process was carried out. The vacuum envelope was evacuated again to reduce the internal pressure to $1\times10^{-8}$ Pa, while heating the entire envelope 48 by means of a heater 131 as shown in FIG. 13.

A quadrupole mass spectrometer was connected immediately downstream relative to the exhaust pipe 132 and the residual gas was observed to see that no n-hexane was found there to prove it had been satisfactorily removed from the vacuum envelope.

Subsequently, a gas feeding process was carried out. More specifically, methane was introduced into the vacuum envelope until the pressure rose to $2\times10^{-4}$ Pa.

Figure 13:
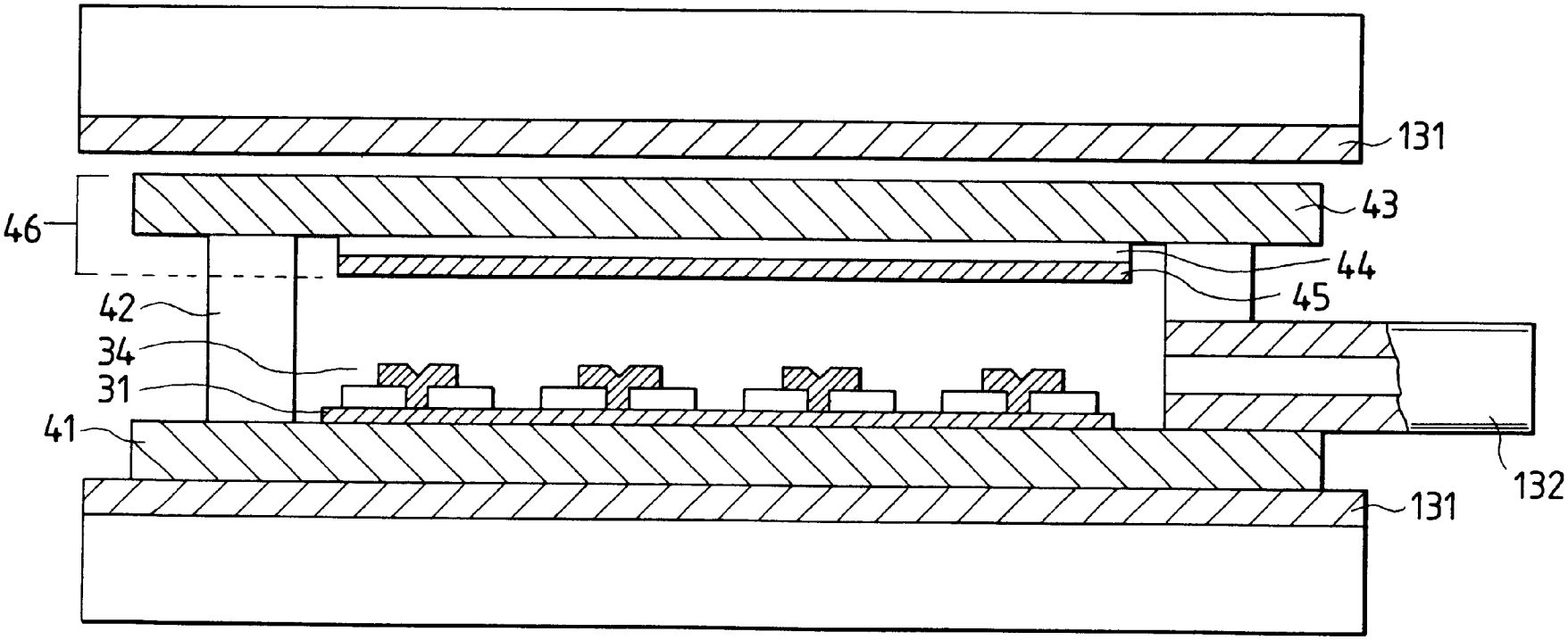
FIG. 13 is a schematic diagram of an apparatus to be used for the stabilization process in the manufacture of an image-forming apparatus according to the invention.

Note that the wirings are omitted in FIG. 13 for the purpose of simplification.

Thereafter, the image-forming apparatus was driven in order to see that it operated normally and stably to display images. Then, the exhaust pipe was heated and fused with a gas burner to hermetically seal the vacuum envelope and finally, a getter process was carried out to heat a getter (not shown) by means of high frequency heating.

COMPARATIVE EXAMPLE 1

The steps of Example 1 were followed up to the activation process. Thereafter, the vacuum envelope was evacuated and a stabilization process was carried out, when the exhaust pipe was sealed without introducing methane. Then, a getter process was carried out to heat a getter (not shown) by means of high frequency heating.

COMPARATIVE EXAMPLE 2

The steps of Example 1 were followed up to the activation process. Thereafter, the vacuum envelope was evacuated and a stabilization process was carried out. Subsequently, ethylene glycol ($HOCH_2CH_2OH$) was introduced in place of methane in the gas feeding process.

While the mean absorption time of methane is estimated to be on the order of several nanoseconds or less as described earlier, that of ethylene glycol is measured by the method described earlier tens of several milliseconds or longer.

The apparatus of Example 1 and those of Comparative Examples 1 and 2 were driven for light emission with a drive frequency of 60 Hz or a drive period of 16.7 milliseconds, which is far longer than the mean absorption time of methane but slightly shorter than that of ethylene glycol. The electric potential of the metal back was held to 1 kV and the emission current was observed.

Figure 17:
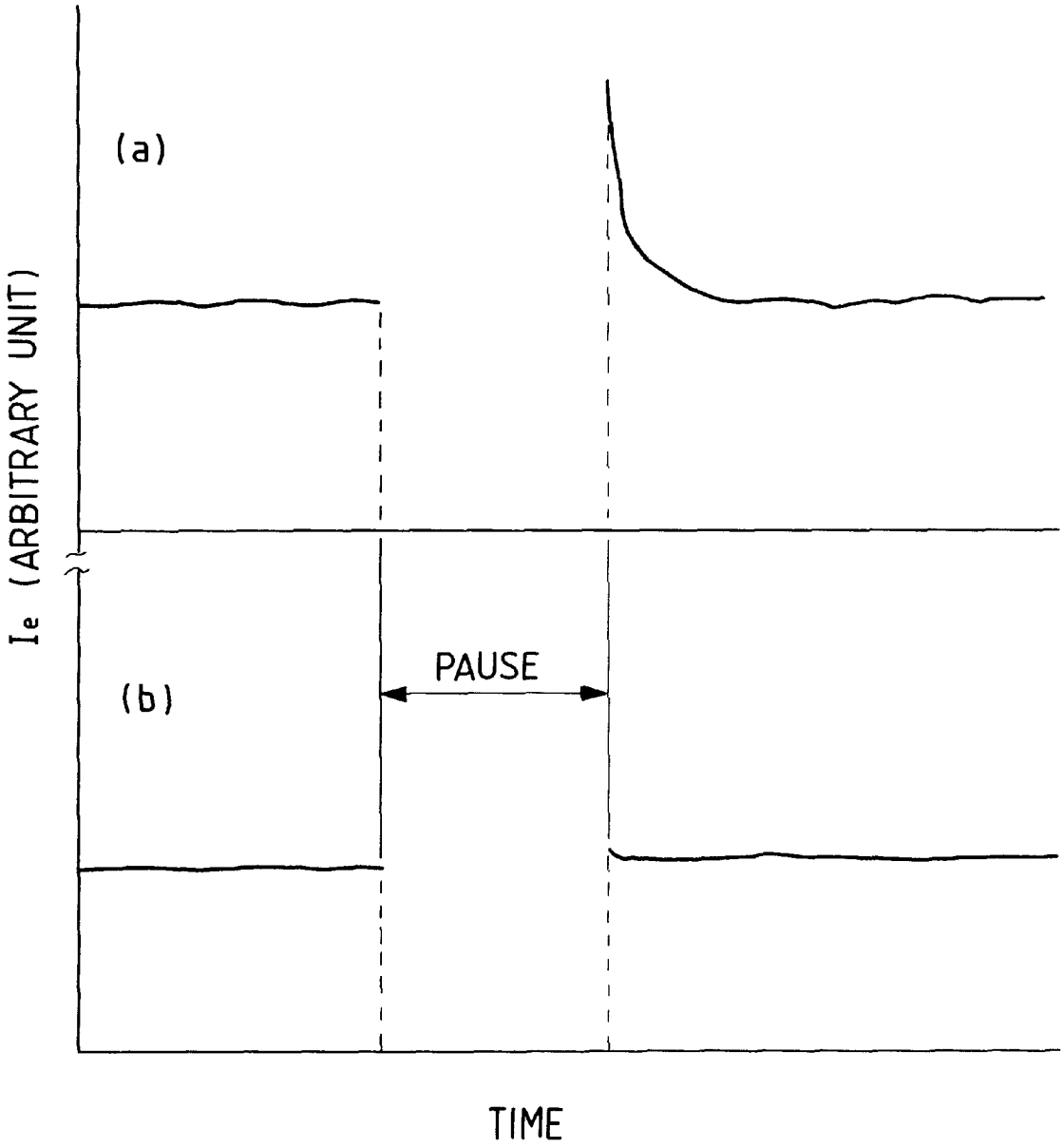
FIG. 17 is a graph illustrating the difference in the emission current before and after a pause of pulsed voltage application for an image-forming apparatus according to the invention and a comparable known apparatus, showing the advantage of the invention.

FIG. 17 illustrates a graph showing the result of the observation on Example 1 and Comparative Example 2, where the emission current was observed when a pulse voltage was applied again after a pause of 10 seconds. In FIG. 17, (a) indicates the electron-emitting performance of Comparative Example 2 whose Ie showed an abrupt rise immediately after the resumption of the pulse voltage application before it fell to the normal level. On the other hand, (b) indicates the performance of Example 1 that was not affected by the pause in the pulse voltage application. This was probably due to the mean absorption time of ethylene glycol that is longer than the ordinary pulse interval and allowed the gas to be adsorbed during the pause so that the emission current abruptly rose immediately after the resumption of the pulse voltage application.

This phenomenon is of course not desirable because it represents a display screen that becomes undesirably and glaringly bright when it shows a light image after displaying a dark image for some time.

Then, the image-forming apparatus were observed by applying a pulse voltage only to an X-directional device row.

The pulse voltage was a rectangular pulse voltage having a pulse interval of 16.7 msec. and a wave height of 15V, whose pulse width was varied between 2 and 8 msec. to see the emission current. While the apparatus of Example 1 showed a constant level of emission current regardless of the pulse width, the emission current of Comparative Example 2 fell when the pulse width become longer.

Then, the Vf-If relationship was observed on each of the image-forming apparatus by applying a triangular pulse voltage having a pulse interval of 16.7 msec. and a pulse width of 30 $\mu$sec. to see the emission current. A wave height of 15V was selected initially, which was thereafter reduced to 10V. While the apparatus of Example 1 did not show any change in the Vf-If relation for the two wave height, both the device current and the emission current of Comparative Example 2 rose gradually after switching to the wave height of 10V to vary its electric performance.

Thereafter, Vf being applied to the same device row was raised from 0V to 15V with a sweeping time of 10 seconds to see the electric performance of the apparatus. The devices of Example 1 showed an MI characteristic as illustrated in FIG. 20 that was same as the result of the above experiment using a triangular pulse voltage regardless of the conditions, whereas their counterparts of Comparative Example 2 showed a VCNR characteristic for the If-Vf relationship.

EXAMPLE 2 AND COMPARATIVE EXAMPLE 3

The steps of Example 1 were followed except that the partial pressure of the introduced methane was differentiated within a range between $2\times10^{-7}$ Pa and $5\times10^{-3}$ Pa.

EXAMPLE 4

The steps of Example 1 were followed except that the partial pressure of the introduced methane was set to a level of $1\times10^{-3}$ Pa and helium gas was additionally introduced until the total internal pressure of the vacuum envelope got to $5\times10^{-3}$ Pa.

Ie was observed as in the case of Example 1 and the values obtained an hour after the start of observation were compared to obtain a result as summarily shown in FIG. 10. It was found that a partial pressure of methane between $1\times10^{-6}$ Pa and $1\times10^{-3}$ Pa provides a desirable performance on the part of image-forming apparatus.

The change with time in Ie for Examples 1 and 2 and Comparative Examples 1 and 3 are also shown in FIG. 1 for partial pressures of methane of a: $1\times10^{-3}$ Pa, b: $1\times10^{-4}$ Pa, c: $1\times10^{-5}$ Pa, d: $1\times10^{-6}$ Pa, e: $2\times10^{-7}$ Pa and f: no methane.

On the other hand, both the apparatus of Comparative Example 3 having a methane partial pressure of $5\times10^{-3}$ Pa and that of Comparative Example 4 having a total pressure of $5\times10^{-3}$ Pa and containing both methane and helium gave rise to electric discharge before the applied pulse voltage got to 1 kV to raise the electric potential of the metal back and became totally inoperative for image display. No electric discharge occurred in the remaining apparatus when the potential of the anode was raised to 5 kV for operation.

From the above observations, it can be concluded that the apparatus is degraded rapidly in terms of Ie when the methane partial pressure falls below $10^{-6}$ Pa so that the partial pressure of methane has to be held above $10^{-6}$ Pa. No noticeably degradation is observed when the methane partial pressure is found between $10^{-4}$ Pa and $1\times10^{-3}$ Pa and hence a partial pressure within this range is particularly preferable.

Note that, however, the anode voltage does not rise satisfactorily when the total pressure exceeds $1\times10^{-3}$ Pa.

EXAMPLE 3 AND COMPARATIVE EXAMPLE 5

The manufacturing steps of Example 1 were followed except that methane was replaced by a mixture gas of methane and hydrogen and the internal pressure of the vacuum envelope was held to $1\times10^{-4}$ Pa. Different methane contents were selected for the mixture gas within a range of between 0.2 and 50% (mole ratio).

Figure 18:
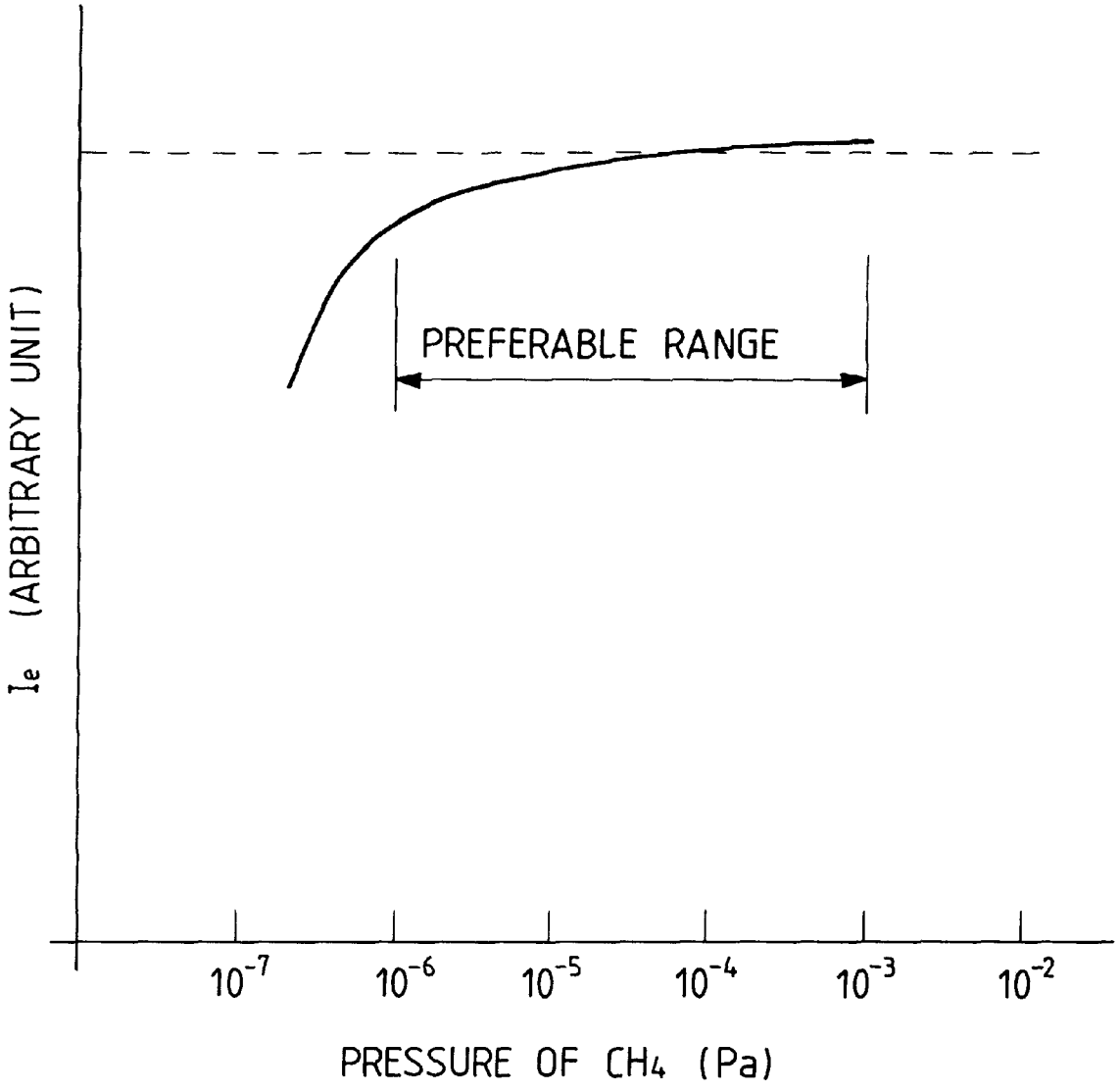
FIG. 18 is a graph illustrating the relationship between the pressure of the sealed methane and the emission current of an image-forming apparatus according to the invention and that of a comparable known apparatus, showing the advantage of the invention.
Figure 19:
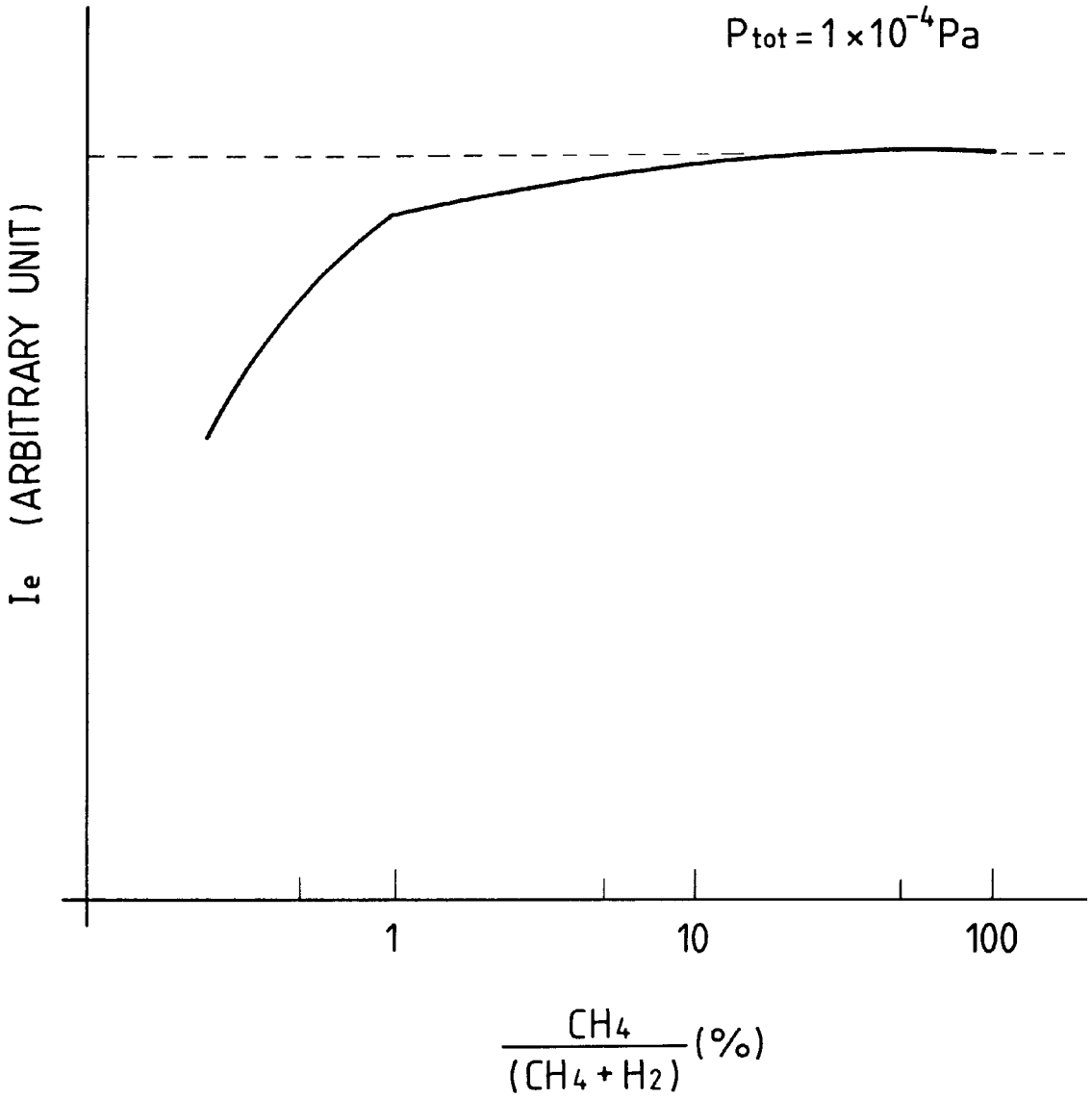
FIG. 19 is a graph illustrating the relationship between the methane content of the sealed mixture gas and the emission current of an image-forming apparatus according to the invention and that of a comparable known apparatus, showing the advantage of the invention.

The emission current Ie was observed as in the case of Example 1 and the values obtained an hour after the start of observation were compared to obtain a result as summarily shown in FIG. 18. (100% represent the value of Example 2.)

It was found that a partial pressure of methane greater than $1\times10^{-6}$ Pa, or a methane content greater than 1%, does not give rise to any degradation in the performance of the apparatus in terms of Ie, whereas the performance is remarkably degraded when the methane content undergoes 0.5% or the methane partial pressure is lower than $5\times10^{-7}$ Pa.

The result of an observation using an apparatus prepared in this Example and having a methane content of 50% (or a methane partial pressure of $5\times10^{-5}$ Pa) and the comparable figures obtained by using a methane partial pressure of $5\times10^{-5}$ Pa in Example 2 were compared. The electron-emitting efficiency, or the ratio Ie/If of the emission current Ie to the device current If, was 0.10% for Example 2, whereas it was 0.12% for Example 3. It may be safely presumed that paths for the electric current not contributing to electron emission were formed, if small, by introducing gaseous organic substances into the vacuum envelope of the image-forming apparatus of Example 2, whereas such paths, if any, for the electric current not contributing to electron emission were narrowed to improve the electron-emitting efficiency by introducing hydrogen gas to increase the number of hydrogen radicals in the atmosphere within the vacuum envelope of Example 3, thereby providing an enhanced etching effect.

EXAMPLE 4 AND COMPARATIVE EXAMPLE 6

The steps of Examples 1 and 2 and those of Comparative Example 3 were followed to prepare respective image-forming apparatuses except that methane was replaced by ethylene $C_2H_4$ having a double bond in the molecule. Since the mean absorption time of ethylene is estimated to be tens of several nanoseconds to 100 nsec. as described earlier, it is by far shorter than the drive period of 16.7 msec. for a drive voltage with 60 Hz.

When measured, they provided results substantially same as those of Examples 1 and 2 and Comparative Example 3. The prepared apparatuses operated effectively when the ethylene partial pressure was between $1\times10^{-6}$ Pa and $1\times10^{-3}$ Pa, preferably above $1\times10^{-4}$ Pa.

EXAMPLE 5

The manufacturing steps of Example 1 were followed except that methane was replaced by $5\times10^{-5}$ Pa of acetylene $C_2H_2$ having a triple bound in the molecule. Since the mean absorption time of acetylene is estimated to be hundreds of several nanoseconds to 1 $\mu$sec as described earlier, it is by far shorter than the drive period of 16.7 msec. for a drive voltage with 60 Hz.

When measured, the provided results substantially same as those of Comparative Example 1 to prove the prepared image-forming apparatus can effectively suppress degradation in the performance.

EXAMPLE 6

The manufacturing steps of Example 1 were followed except that methane was replaced by butadiyne $C_4H_2$ having triple bonds in the molecule. The value of $\tau$ could not be determined when measured with the method as described earlier because L in FIG. 10 was too small. The reason for this may be that $\tau$ is by far smaller than a millisecond. Thus, it is clearly by far shorter than the drive period of 16.7 msec. for a drive voltage with 60 Hz.

When measured, the provided results substantially same as those of Example 1 to prove the prepared image-forming apparatus can effectively suppress degradation in the performance.

EXAMPLE 7

The manufacturing steps of Example 1 were followed except that n-hexane was replaced by methane in the activation process. A pressure of 1300 Pa was used. A pulse voltage with a wave height of 15V was applied as in the case of Example 1.

After the activation process, the vacuum envelope was evacuated to a pressure level lower than $1\times10^{-8}$ Pa. This evacuation process was carried out within a time shorter than the comparable time of Example 1 where n-hexane was used for the activation process. Thereafter, the gas feeding process was conducted, where methane was used to realize a pressure level same as that of Examples 1 and 2.

The emission current Ie was observed for changes as in the case of Examples 1 and 2 to obtain similar results.

As described above in detail, by sealing gaseous organic substances having a mean absorption time shorter than the drive period of the electron-emitting devices into the vacuum envelope of the image-forming apparatus, the electron-emitting devices were stably provided with a desirable MI characteristic of unequivocally defining both the device current If and the emission current Ie in terms of the device voltage Vf to a great advantage on the part of the image-forming apparatus. The partial pressure of the organic substances is preferably greater than $1\times10^{-6}$ Pa and more preferably greater than $1\times10^{-4}$ Pa and the total internal pressure of the vacuum envelope should be not greater than $1\times10^{-3}$ Pa.

The electron-emitting performance of the image-forming apparatus is preferably improved by sealing hydrogen gas along with gaseous organic substances.

What is claimed is:

1. An image-forming apparatus comprising an electron source including one or more than one electron-emitting devices on a substrate, each electron-emitting device having a pair of oppositely disposed device electrodes, an electroconductive film connected to the pair of device electrodes and an electron-emitting region formed in part of the electroconductive film accompanied by a carbonaceous film which contains carbon or carbon compound as principal ingredient and is formed on and in a vicinity of the electron-emitting region, and an image-forming member for forming an image by emitting light when irradiated with electron beams emitted from the electron source, the electron source and the image-forming member being contained in a vacuum envelope, characterized in that an organic substance exists in the vacuum envelope to show a partial pressure of the organic substance greater than $1\times10^{-6}$ Pa and a total pressure lower than $1\times10^{-3}$ Pa, the organic substance being so selected that it shows a mean absorption time shorter than the drive period of the electron source.

2. An image-forming apparatus according to claim 1, characterized in that the partial pressure of the organic substance is not lower than $1\times10^{-4}$ Pa.

3. An image-forming apparatus according to claim 1, wherein hydrogen gas exists in the vacuum envelope in addition to the organic substance.

4. An image-forming apparatus according to any of claims 1 through 3, characterized in that the organic substance is $CH_4$ (methane), $C_2H_4$ (ethylene), $C_2H_2$ (acetylene) or $C_4H_2$ (butadiyne).

5. A method of manufacturing an image-forming apparatus comprising an electron source including one or more than one electron-emitting devices on a substrate, each electron-emitting device having a pair of oppositely disposed device electrodes, an electroconductive film connected to the pair of device electrodes and an electron-emitting region formed in part of the electroconductive film accompanied by a carbonaceous film which contains carbon or carbon compound as principal ingredient and is formed on and in a vicinity of the electron-emitting region, and an image-forming member for forming an image by emitting light when irradiated with electron beams emitted from the electron source, the electron source and the image-forming member being contained in a vacuum envelope, characterized in that it comprises an energization forming step for producing said electron-emitting regions, an activation step for forming said carbonaceous films containing carbon or carbon compound as principal ingredient by deposition on and in a vicinity of the electron-emitting region of each of the electron-emitting devices by introducing an organic substance into the vacuum envelope and applying a pulse voltage to the device, a stabilization step for removing the organic substance remaining in the vacuum envelope after the end of the activation step and a gas feeding step for introducing an organic substance having a mean absorption time shorter than the drive period of the electron-emitting devices or a mixture gas of the organic substance and hydrogen gas, the partial pressure of the organic substance having a mean absorption time longer than the drive period of the electron-emitting devices being held not greater than $1.0\times10^{6}$ Pa.

6. A method of manufacturing an image-forming apparatus according to claim 5, characterized in that the internal pressure of the vacuum envelope is held not greater than $1.0\times10^{-6}$ Pa in the stabilization step.

7. A method of manufacturing an image-forming apparatus according to claim 5, characterized in that the organic substance introduced into the vacuum envelope in the activation step is same as the organic substance introduced in the gas feeding step.

8. A method of manufacturing an image-forming apparatus according to claim 5, characterized in that the organic substance having a mean absorption time shorter than the drive period of the electron-emitting devices is $CH_4$ (methane), $C_2H_4$ (ethylene), $C_2H_2$ (acetylene) or $C_4H_2$ (butadiyne).

9. An electron emission apparatus comprising:

a) a sealed envelope containing therein an electron-emitting device, said electron-emitting device having a carbonaceous film comprising carbon or a carbon compound; and b) voltage application means for applying a voltage to said electron-emitting device at an interval greater than $3.57\times10^{-7}$ sec, wherein said sealed envelope has an inner atmosphere showing a total pressure lower than $1\times10^{-3}$ Pa, said inner atmosphere comprises an organic substance selected from methane, ethylene or acetylene, and said organic substance shows a partial pressure higher than $1\times10^{-6}$ Pa.

10. An electron emission apparatus according to claim 9, wherein said inner atmosphere further comprises hydrogen.

11. An electron emission apparatus according to claim 9, wherein said interval is greater than 16 msec.

12. An electron emission apparatus according to claim 9, wherein said apparatus further comprises an acceleration electrode for accelerating electrons emitted from said electron-emitting device.

13. An electron emission apparatus according to claim 12, wherein a fluorescent body is arranged on said acceleration electrode.

14. An electron emission apparatus according to claim 13, wherein said fluorescent body emits light of the three primary colors by irradiation with electrons emitted from said electron-emitting device.

15. An electron emission apparatus according to claim 9, wherein said electron-emitting device further comprises an electroconductive film having a gap, and said carbonaceous film is arranged on said electroconductive film.

16. An electron emission apparatus according to claim 9, wherein said electron-emitting device further comprises a pair of electroconductive films oppositely disposed with a gap interposed therebetween and said carbonaceous film is arranged on said pair of electroconductive films.

17. An electron emission apparatus according to claim 9, wherein said carbonaceous film comprises a pair of carbonaceous films oppositely disposed with a first gap interposed therebetween.

18. An electron emission apparatus according to claim 17, wherein said electron-emitting device further comprises an electroconductive film having a second gap, and said pair of carbonaceous films are arranged on said electroconductive film.

19. An electron emission apparatus according to claim 17, wherein said electron-emitting device further comprises a pair of electroconductive films oppositely disposed with a second gap interposed therebetween, and said pair of carbonaceous films are arranged on said pair of electroconductive films.

20. An electron emission apparatus according to claim 18 or 19, wherein said first gap has a shorter distance than said second gap, and said first gap is located in said second gap.

21. An electron emission apparatus according to claim 9, wherein said sealed envelope contains therein a plurality of electron-emitting devices.

22. An electron emission apparatus according to claim 21, wherein said plurality of electron-emitting devices are connected to a plurality of row-directional wires and to a plurality of column-directional wires generally perpendicular to said row-directional wires.

23. An electron emission apparatus according to claim 21 or 22, wherein said apparatus further comprises an acceleration electrode for accelerating electrons emitted from said electron-emitting devices and a fluorescent body arranged on said acceleration electrode.

24. A method of manufacturing an electron emission apparatus, comprising steps of:

a) arranging an electron-emitting device in an envelope, said electron-emitting device having a carbonaceous film comprising carbon or a carbon compound;

b) evacuating said envelope to have a partial pressure of organic substances therein become lower than $1.3\times10^{-6}$ Pa;

c) introducing into said envelope an organic substance selected from methane, ethylene or acetylene to have a partial pressure of said organic substance become higher than $1\times10^{-6}$ Pa; and d) electrically connecting said electron-emitting device to a voltage application means for applying a voltage at an interval greater than $3.57\times10^{-7}$ sec.

* * * * *

UNITED STATES PATENT AND TRADEMARK OFFICE

CERTIFICATE OF CORRECTION

PATENT NO. : 5,998,924

DATED : December 7, 1999

INVENTOR(S): KEISUKE YAMAMOTO, ET AL.

It is certified that error appears in the above-identified patent and that said Letters Patent is hereby corrected as shown below:

COVER PAGE AT ITEM [54] TITLE:
"IMAGE/FORMING" should read --IMAGE FORMING--.

COVER PAGE AT ITEM [57] RC:
Other Publications: "emmission" should read --emission--.

COLUMN 1:
Line 40, "device;" should read --devices;--.

COLUMN 9:
Line 1, "an" should read --a--.

COLUMN 12:
Line 38, "an" should read --a--.

UNITED STATES PATENT AND TRADEMARK OFFICE

CERTIFICATE OF CORRECTION

PATENT NO. : 5,998,924

DATED : December 7, 1999

INVENTOR(S): KEISUKE YAMAMOTO, ET AL.

It is certified that error appears in the above-identified patent and that said Letters Patent is hereby corrected as shown below:

COLUMN 14:

Line 23, "be" should be deleted; and

Line 50, "finish" should read --finishing--

Signed and Sealed this

Twenty-sixth Day of December, 2000

*Attest:*

Q. TODD DICKINSON

*Attesting Officer*

*Director of Patents and Trademarks*